US008469347B2

(12) United States Patent
Hata

(10) Patent No.: US 8,469,347 B2
(45) Date of Patent: Jun. 25, 2013

(54) SHEET PERFORATION APPARATUS INCLUDING AN ALIGNING DEVICE AND POST-PROCESSING APPARATUS AND IMAGE FORMING SYSTEM INCLUDING PERFORATION APPARATUS

(75) Inventor: Kiyoshi Hata, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 323 days.

(21) Appl. No.: 12/718,017

(22) Filed: Mar. 5, 2010

(65) Prior Publication Data

US 2010/0232912 A1 Sep. 16, 2010

(30) Foreign Application Priority Data

Mar. 11, 2009 (JP) ..... 2009-057838

(51) Int. Cl.
*B26F 1/02* (2006.01)

(52) U.S. Cl.
USPC ..... 270/58.07; 270/58.17; 399/407

(58) Field of Classification Search
USPC ..... 270/58.07, 58.17; 399/407
See application file for complete search history.

(56) References Cited

U.S. PATENT DOCUMENTS 5,992,839 A * 11/1999 Kosasa ..... 270/58.12
6,361,036 B1 * 3/2002 Nakazawa ..... 270/58.07
7,007,577 B2 * 3/2006 Okamoto et al. ..... 83/76.8
7,192,020 B2 * 3/2007 Hayashi et al. ..... 270/58.11
7,520,497 B2 * 4/2009 Moriyama et al. ..... 270/58.07
7,578,498 B2 * 8/2009 Iguchi et al. ..... 270/58.07
7,581,725 B2 * 9/2009 Fujita et al. ..... 270/58.17
7,954,811 B2 * 6/2011 Ishikawa et al. ..... 271/245
2009/0065999 A1 * 3/2009 Iguchi et al. ..... 270/58.08

FOREIGN PATENT DOCUMENTS

JP 2004-217337 A 8/2004
JP 2004217337 A * 8/2004
JP 2005-138972 A 6/2005
JP 2005-200135 A 7/2005
JP 2007084302 A * 4/2007

OTHER PUBLICATIONS

Japanese Office Action dated Jan. 8, 2013 (and English translation thereof) in counterpart Japanese Application No. 2009-057838.

* cited by examiner

*Primary Examiner* — Patrick Mackey
(74) *Attorney, Agent, or Firm* — Holtz, Holtz, Goodman & Chick, P.C.

(57) ABSTRACT

A perforation apparatus, having: a perforation device to perforate a sheet by a punch; a pair of aligning members to align the sheet in a sheet width direction; and a contact member to contact with an trailing edge of the sheet, capable of being inserted and retracted with respect to a conveyance path of the sheet, disposed at an upstream side of the punch in the sheet conveyance direction; wherein the sheet is moved and aligned to a sheet aligning position while being grasped by the aligning members, the aligning device is retracted from the sheet aligning position after the aligning operation is completed, subsequently the contact member pushes the trailing edge of the sheet and conveys the sheet to a predetermined position, then the sheet is perforated by the perforation device.

18 Claims, 20 Drawing Sheets

SHEET PERFORATION APPARATUS INCLUDING AN ALIGNING DEVICE AND POST-PROCESSING APPARATUS AND IMAGE FORMING SYSTEM INCLUDING PERFORATION APPARATUS

This application is based on Japanese Patent Application No. 2009-057838 filed on Mar. 11, 2009, in Japanese Patent Office, the entire content of which is hereby incorporated by reference.

BACKGROUND OF THE INVENTION

The present invention relates to a perforation apparatus to perforate at a predetermined perforation position on a sheet by a punch, a post-processing apparatus having the perforation apparatus and an image forming apparatus having the post-processing apparatus.

TECHNICAL FIELD

A recent image forming apparatus of electrophotographic method possesses a high speed performance, a multifunction and a network function, and by being connected with a large capacity sheet feeding apparatus and a large capacity stacker, usage as a printing apparatus is expanding. In case the image forming apparatus is used as a printing apparatus, by connecting a post-processing apparatus to perform bookbinding of printed matters (sheets on which images are formed) one image forming apparatus can perform processes from printing to bookbinding.

As the post-processing apparatus, for example, there is known a bookbinding apparatus downsized by disposing a sheet bundle storing section, a glue application section, a coversheet supply section, and a coversheet folding section in a vertical direction serially. In the bookbinding apparatus, a booklet is formed by applying glue evenly on a spine of the sheet bundle stored and grasped in the sheet bundle storing section with a glue application roller. However, in case the glue is applied only on the spine, since the adhesion area is limited, strength of the glued booklet is not sufficient. Thus, a notch is formed at an edge side where the glue is applied when bookbinding of the sheets are performed, so as to increase the bonding area and as a result, an adhesion force is increased.

Forming notch is hereinafter also called roughing.

Also, the sheet on which the image is formed is often subject to filing process other than bookbinding by the glue. Thus the perforation apparatus is used to form punching hole for filing.

In forming the notch or the punching hole by the perforation apparatus, if perforation is carried out while each sheet is displaced or skewed, the position of hole or notch is deviated from a predetermined position thus there is a problem that sheets are irregularly filed or bound which looks ugly. For example, in case the peroration position of the sheet is controlled by using the sheet conveyance drive system, if a sheet conveyance speed is 1000 mm/m sec, a control error of 1 sec creates a sheet displacement of 1 mm. Such deviation of perforation hole position due to control error becomes noticeable in a high speed apparatus.

In respect to the above problem, there is disclosed a perforation process where the sheet is grasped by the conveyance rollers to be conveyed to a predetermined stop position, grasping of the conveyance rollers is released, the aligning device aligns the sheets in a width direction, then the sheets are grasped by the conveyance rollers again further, after contacting the contact member inserted into the conveyance path with the trailing edge of the sheet, the sheet is subject to a perforation process through a perforation device (for example, refer to Patent Document 1: Unexamined Japanese Patent Application Publication No. 2004-217337)

Patent Document 1: Unexamined Japanese Patent Application Publication No. 2004-217337

SUMMARY

The invention of the Patent Document 1 provided with a contact member which is driven separately from a sheet conveyance drive is to minimize displacement of the perforation position by aligning the sheet so as to minimize variations of perforation position in a sheet conveyance direction as well as the width direction.

However, in aligning in the width direction of the sheet, a distance between aligning plates representing the aligning member of the aligning device is usually set 0.5 mm wider than the width of the normal sheet, however since the cutting tolerance of the sheet is ±2 mm, there are cases that the aligning plates grasp the sheet and not grasp the sheet. In Patent Document 1, the positioning in the sheet conveyance direction is carried out by the contact member in a state where aligning in the width direction is carried out by the aligning plate. Thus in case the sheet cutting width is more than 0.5 mm, positioning in sheet conveyance direction is carried out in the state where the aligning plates grasp the sheets. Thus, when the contact member pushes the sheets, there is occur irregularity of slippage and deformation of the sheet. Whereby, there is a possibility that positional accuracy of notch forming (or perforation) is deteriorated.

One aspect of the present invention comprises:

1. A perforation apparatus, comprising:

a perforation device which perforates a sheet by a punch;

an aligning device having a pair of aligning members which aligns the sheet in a sheet width direction which is orthogonal to a sheet conveyance direction;

a contact member which contacts with an trailing edge of the sheet, capable of being inserted and retracted with respect to a conveyance path of the sheet, disposed at an upstream side of the punch in the sheet conveyance direction; and a control device which controls perforation, wherein the control device controls in a way that the sheet is moved and aligned to a sheet aligning position while being grasped by the aligning members, the aligning device is retracted from the sheet aligning position after the aligning operation is completed, subsequently the contact member pushes the trailing edge of the sheet and conveys the sheet to a predetermined position, then the sheet is perforated by the perforation device.

2. The perforation device of item 1, wherein the control device controls in a way that the sheet is moved to a sheet aligning position while being grasped by the aligning members so as to be aligned in a state where the contact member is retracted, the aligning device is retracted from the sheet aligning position after the aligning operation is completed, subsequently the contact member is inserted into the sheet conveyance path so as to contact with the trailing edge of the sheet, and the sheet is pushed and conveyed to a predetermined position.

3. The perforation device of item 1, wherein the control device starts the aligning operation of the aligning device and an operation of the contact member simultaneously, and terminate the operation of the contact member after the aligning member is retracted from the sheet aligning position.

4. The perforation device of item 1, further comprising a conveyance device, having conveyance rollers configured with a drive roller and a driven roller, which are capable of pressing and releasing, disposed at a downstream side in the sheet conveyance direction with respect to the perforation device to convey the sheet by grasping the sheet with the drive roller and the driven roller, wherein the control device releases the conveyance rollers while the sheet is being aligned by the aligning device and while the contact member is pushing the sheet to convey the sheet.

5. The perforation apparatus of item 4, wherein the control device controls the conveyance rollers being released to be in a pressure state again before perforating the sheet.

6. The perforation apparatus of item 1, wherein a half circle notch is formed on an edge of the sheet by perforating a hole in a way that the hole overhangs from the edge of the sheet.

7. A post-processing apparatus, comprising:

the perforation apparatus of item 1, and a connection device with an image forming apparatus.

8. The post-processing apparatus of item 7, wherein the control device controls in a way that the sheet is moved to a sheet aligning position while being grasped by the aligning members so as to be aligned in a state where the contact member is retracted, the aligning device is retracted from the sheet aligning position after the aligning operation is completed, subsequently the contact member is inserted into the sheet conveyance path so as to contact with the trailing edge of the sheet, and the sheet is pushed and conveyed to a predetermined position.

9. The post-processing apparatus of item 7, wherein the control device starts the aligning operation of the aligning device and the operation of the contact member simultaneously, and terminate the operation of the contact member after the aligning member is retracted from the sheet aligning position.

10. The post-processing apparatus of item 7, further comprising a conveyance device, having conveyance rollers configured with a drive roller and a driven roller, which are capable of pressing and releasing, disposed at a downstream side in the sheet conveyance direction with respect to the perforation device to convey the sheet by grasping the sheet with the drive roller and the driven roller, wherein the control device releases the conveyance rollers while the sheet is being aligned by the aligning device and while the contact member is pushing the sheet to convey the sheet.

11. The post-processing apparatus of item 10, wherein the control device controls the conveyance rollers being released to be in a pressure state again before perforating the sheet.

12. The post-processing apparatus of item 7, wherein a half circle notch is formed on an edge of the sheet by perforating a hole in a way that the hole overhangs from the edge of the sheet.

13. The post-processing apparatus of item 7, further comprising a bookbinding device to receive a sheet on which an image is formed and to perform bookbinding.

14. An image forming system, comprising:

the image forming apparatus to from an image of a sheet, and the post-processing apparatus of item 7 to carry out by receiving sheets on which images are formed.

15. The image forming system of item 14, wherein the control device controls in a way that the sheet is moved to a sheet aligning position while being grasped by the aligning members so as to be aligned in a state where the contact member is retracted, the aligning device is retracted from the sheet aligning position after the aligning operation is completed, subsequently the contact member is inserted into the sheet conveyance path so as to contact with the trailing edge of the sheet, and the sheet is pushed and conveyed to a predetermined position.

16. The image forming system of item 15, wherein the control device starts the aligning operation of the aligning device and an operation of the contact member simultaneously, and terminate the operation of the contact member after the aligning member is retracted from the sheet aligning position.

17. The image forming system of item 15, further comprising a conveyance device, having conveyance rollers configured with a drive roller and a driven roller, which are capable of pressing and releasing, disposed at a downstream side in the sheet conveyance direction with respect to the perforation device to convey the sheet by grasping the sheet with the drive roller and the driven roller, wherein the control device releases the conveyance rollers while the sheet is being aligned by the aligning device and while the contact member is pushing the sheet to convey the sheet.

18. The image forming system of item 17, wherein the control device controls the conveyance rollers being released to be in a pressure state again before perforating the sheet.

19. The image forming system of item 15, wherein a half circle notch is formed on an edge of the sheet by perforating a hole in a way that the hole overhangs from the edge of the sheet.

A perforation apparatus, a post-processing apparatus having the perforation apparatus and an image forming system having the post-processing apparatus related to the present invention will be described with reference to the drawings without the present invention being restricted to the drawings thereof. Incidentally, the post-processing apparatus will be described with a bookbinding apparatus as an example (hereinafter, the post-processing apparatus is also called as a bookbinding apparatus).

Figure 1:
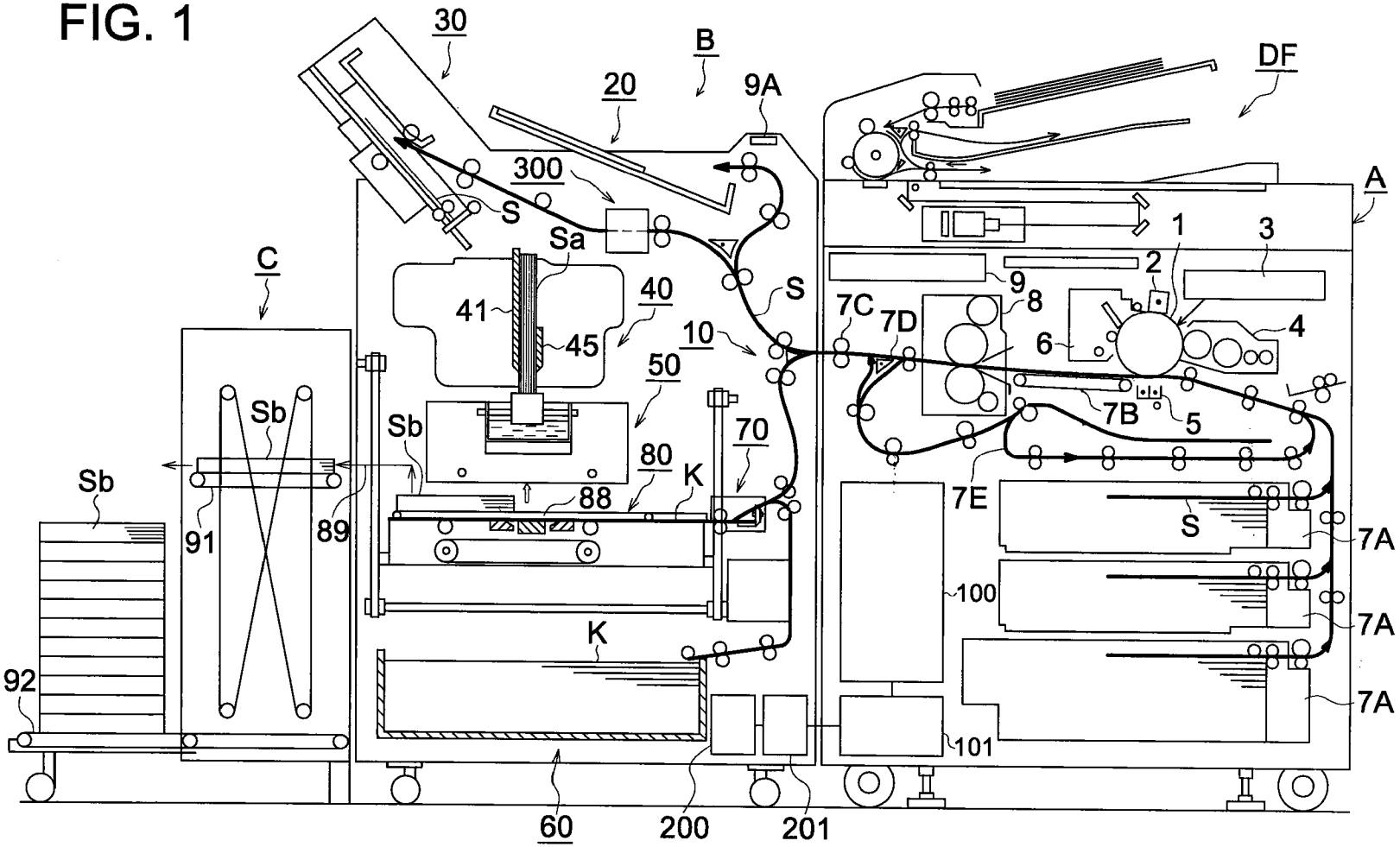
FIG. 1 is a total configuration view of an image forming apparatus having an image forming apparatus main body, a bookbinding apparatus and a booklet storing apparatus.

FIG. 1 is a total configuration view of an image forming system having an image forming apparatus main body A, a bookbinding apparatus B and a booklet storing apparatus C and an automatic document feeding apparatus DF.

[Image Forming Apparatus A]

The image forming apparatus A is provided with an image forming section where a charging section 2, an image wise exposure section 3, a developing section 4, a transfer discharging section 5 and a cleaning section 6 at a periphery of a rotating image carrier 1.

In the image forming section, the charging section 2 charges a surface of the image carrier 1 evenly, a laser beam of the image wise exposure section 3 performs exposure scanning based on image data read from a document to form a latent image and the developing section 4 develops the latent image by reversal development so as to form an toner image on the surface of the image carrier 1.

The sheet S supplied form the sheet storing section 7A is sent to a transfer position. After the toner image is transferred onto the sheet S by the transfer discharging section 5 at the transfer position, charge of the surface of the sheet S is erased so that the sheet S is separated from the image carrier 1, then the sheet S is conveyed through a conveyance section 7B and subsequently subject to heat fixing by a fixing section 8 and then ejected from ejection rollers 7C.

In case image forming is carried out on both sides of the sheet S, the sheet S having been subject to heat fixing by the fixing section 8 is branched from an ejection path through a conveyance path changeover section 7D, and flipped over by switch-back in a reversal conveyance section 7E, after that, the sheet S is conveyed to the image forming section again to form an image on a reverse side of the sheet S, then via the fixing section 8, the sheet S is ejected from the ejection rollers 7C to an outside of the apparatus. The sheet S ejected from the ejection rollers 7C is sent to a bookbinding apparatus B.

After image forming, residual toner is removed from the surface of the image carrier 1 through a cleaning section 6 to be ready for subsequent image forming.

At an upper part of the image forming apparatus A, an operation section 9 provided with an input section and a display section is disposed.

[Bookbinding Apparatus B]

As FIG. 1 shows, the bookbinding apparatus B is a case binding apparatus having a conveyance path 10, a sheet ejection section 20, a reversal section 30, sheet bundle storage section 40, a adhesive application section 50 and a coversheet supply section 60, a cutting section 70, a booklet forming section 80, and a perforation device 300.

Incidentally, the case binding apparatus B is applicable to a side stitching apparatus, a center folding center stitching apparatus and a seal binding apparatus.

Figure 2:
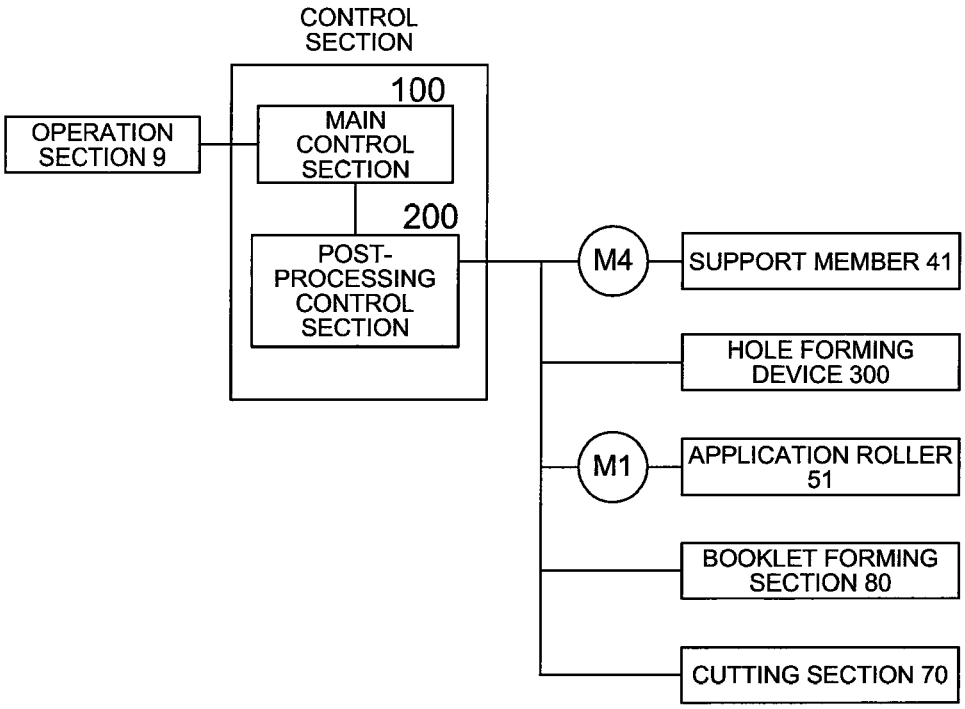
FIG. 2 is a block diagram showing a control of the present embodiment.

FIG. 2 is a block diagram showing control of the present embodiment.

A control section of the present embodiment is configured with a main control section 100 provided at an image forming apparatus A and a post-processing control section 200 representing a control device to control forming of a booklet disposed in the bookbinding apparatus B, which are connected via serial communication sections 101 and 201. The post-processing control section 200 controls each section of the book binding apparatus B based on a command of the main control section 100. The post-processing control section 200 controls to drive each section to be described so as to form a booklet.

Namely, the post-processing control section 200 controls to drive a motor M4 to drive a support member 41 which supports a sheet bundle, a motor M1 to drive a perforation device 300, and an application roller 51, a booklet forming section 80 and a cutting section 70.

Figure 3:
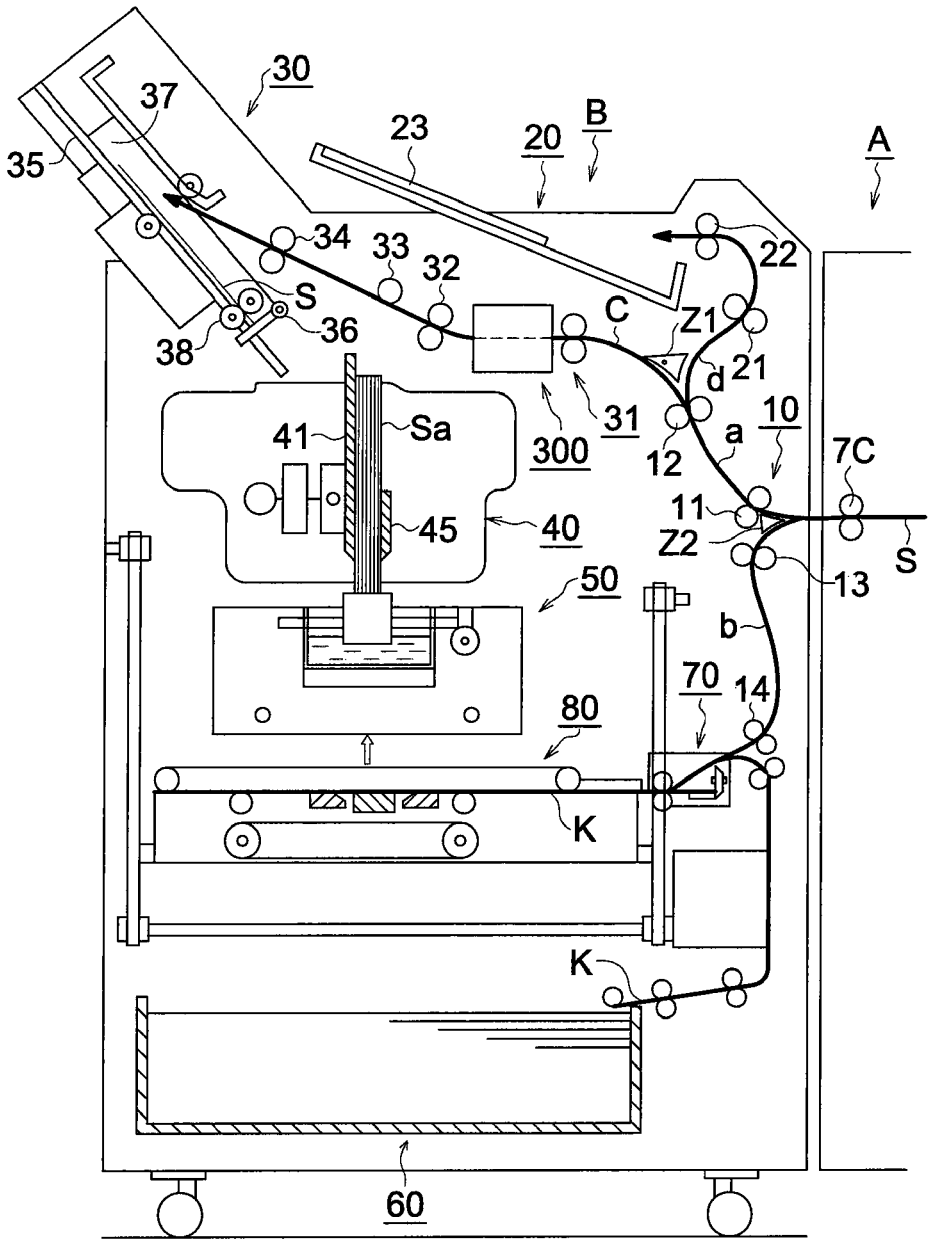
FIG. 3 is a cross-sectional view of a bookbinding apparatus related to the present embodiment.

FIG. 3 is a cross-sectional view of the bookbinding apparatus B related to the present embodiment.

The bookbinding apparatus B has a connection device to be connected with the image forming apparatus A mechanically and electrically.

[Conveyance Path 10]

The sheet S entered in a conveyance path a of the conveyance path 10 of the bookbinding apparatus, is grasped and conveyed by conveyance rollers 11 and 12 and branched to either a sheet ejection section 20 or a reversal section 30 via conveyance path changeover section Z1.

A conveyance path changeover section Z2 disposed at an upstream side of the conveyance roller 11 in the sheet conveyance direction branches the sheet S ejected from the image forming apparatus A to either a conveyance path a or a conveyance path b. The sheet S conveyed to the conveyance path b is grasped by the conveyance rollers 14 and sent to the booklet forming section 80.

[Sheet Ejection Section 20]

When sheet ejection to sheet ejection section 20 is selected, a conveyance path changeover section Z1 interrupts a conveyance path c to a sheet bundle storing section 40 and opens a conveyance path d to the sheet ejection section 20.

The sheet S to pass through a conveyance path d to the sheet ejection section 20 is grasped by the conveyance rollers 21 and conveyed upward and ejected by the ejection roller 22 onto a fixed sheet ejection tray 23 at upper most section of the apparatus and stored.

[Perforation Device 300]

The sheet S branched to the conveyance path c by the conveyance path changeover section Z1 is grasped by the conveyance rollers 31 configured with a drive roller 31*a* and a driven roller 31*b* and conveyed to the perforation device 300.

Figure 4:
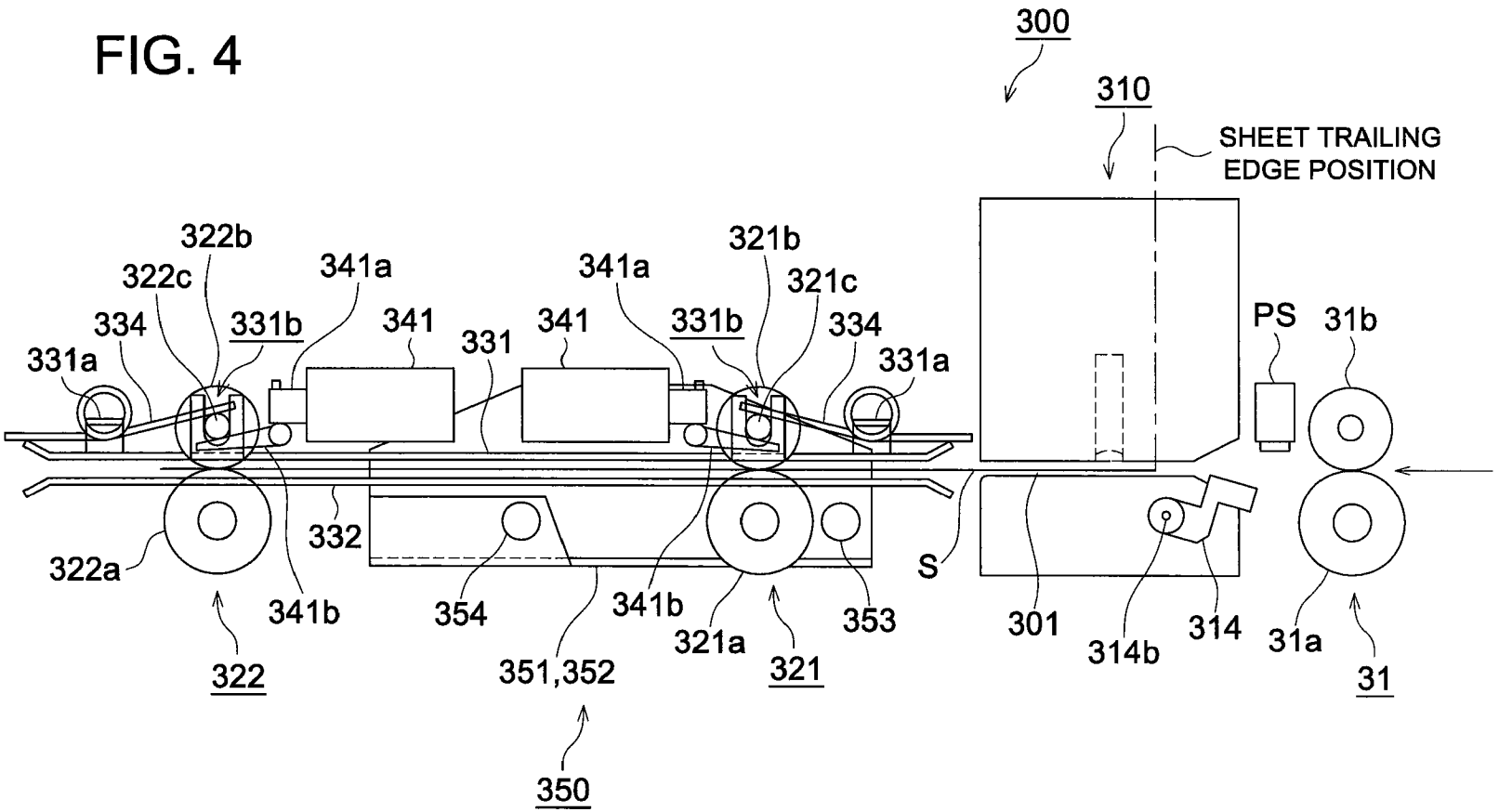
FIG. 4 is a side view of a relevant section showing an exemplary perforation apparatus.
Figure 5:
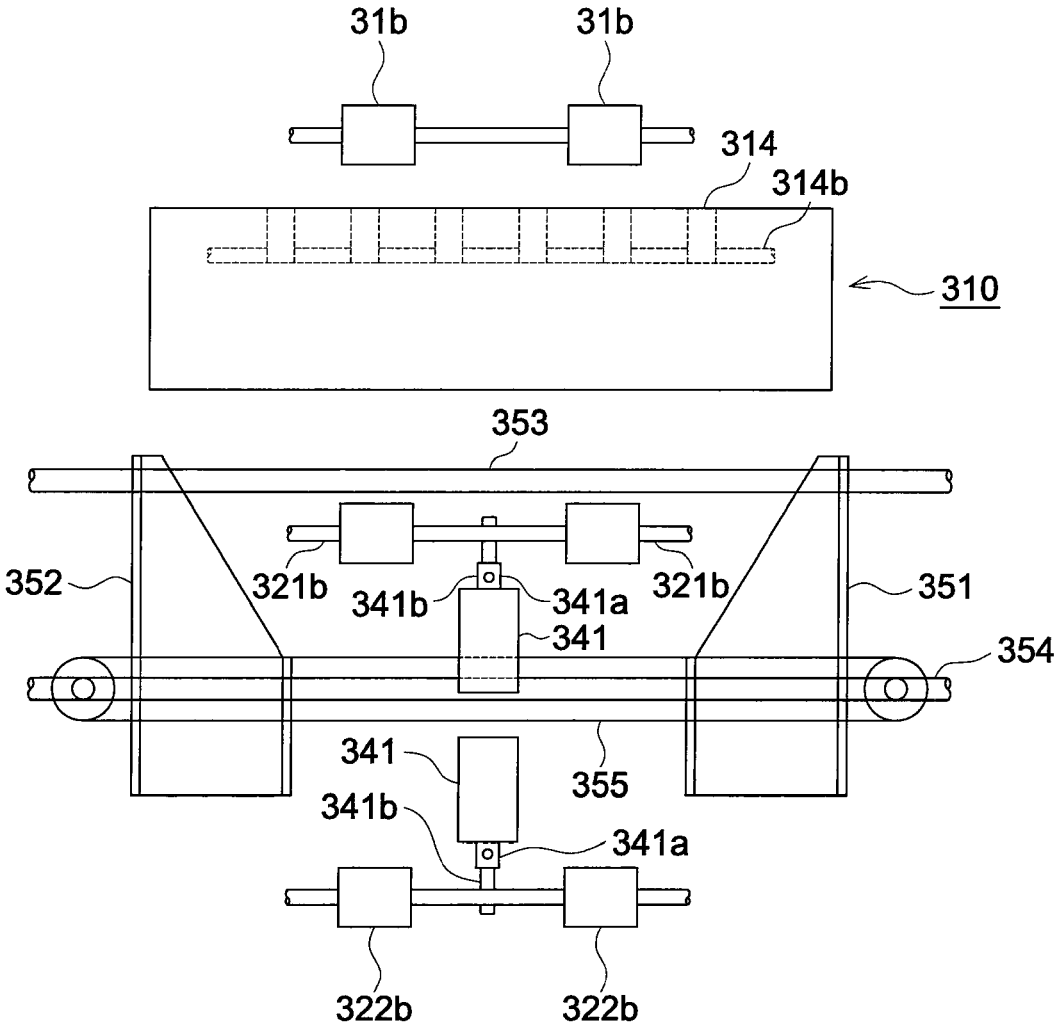
FIG. 5 is a top view of a relevant section showing an exemplary perforation apparatus.

FIG. 4 is a side view of relevant portions of an exemplary perforation device 300, and FIG. 5 is a top view of relevant portions of the perforation device 300.

In the present embodiment, the perforation device 300 forms a notch in a shape of a half circle at a trailing edge of the sheet S.

The conveyance rollers 321 and 322 are configured with drive rollers 321*a* and 322*a* and driven rollers 321*b* and 322*b* which can be contacted with pressure and released respectively. The drive rollers 321 and 322*a* are driven by a motor (unillustrated). Also, an upper guide plate 331 and a lower guide plate 332 are disposed so that the sheet S is surely guided and convey by the conveyance rollers 321 and 322. A torsional coil springs 334 are attached at spring latch sections 331*a* disposed at the upper guide plate 331, and since one end of each torsional coil spring 334 presses support shafts 321*c* and 322*c* of the driven rollers 321*b* and 322*b* respectively, the driven rollers 321*b* and 322*b* press the drive rollers 321*a* and 322*a*. Also, since the driven rollers 321*b* and 322*b* are configured to be released from pressure contact with drive rollers 321*a* and 322*a* and to be movable upward, guide sections 331*b* to guide the support shafts 321*c* and 322*c* are disposed at the upper guide plate 331.

Tensile coil springs, compression coil springs and leaf springs can used to press the driven rollers 321*b* and 322*b* without being limited to the torsional coil springs 334.

Two solenoids 341 are disposed above the upper guide plate 331, and crank levers 341*b* are disposed respectively between each solenoid 341 and the driven rollers 321*b* and 322*b*. An end of each crank lever 341*b* is engaged with a plunger 341*a* of the solenoid 341, and the other ends of the crank levers 341*b* are configured so as to press lower sections of the support shafts 321*c* and 322*c* of driven rollers 321*b* and 322*b*.

Also, there is disposed an aligning device 350 to align the sheet S in width direction by pressing both sides of the sheet S having been conveyed to positions of rollers 321 and 322 in the sheet width direction which is orthogonal to the sheet conveyance direction towards a center of the sheet S. The aligning device 350 is provided with width aligning plates 351 and 352 representing an aligning member. The width aligning plates 351 and 352 are movable in the sheet width direction in opposite directions each other through a belt 355 driven by an unillustrated stepping motor and supported by a support shafts 353 and 354.

The perforation section 310 representing the perforation device is provided with a perforation mechanism 311 to perforate on the sheet S, a moving mechanism 312 to move a relative position between the sheet S and the notch in the sheet width direction orthogonal to the sheet conveyance direction, a trash container 333 to store paper dust of the notch having been cut and a contact member 314.

Figure 8:
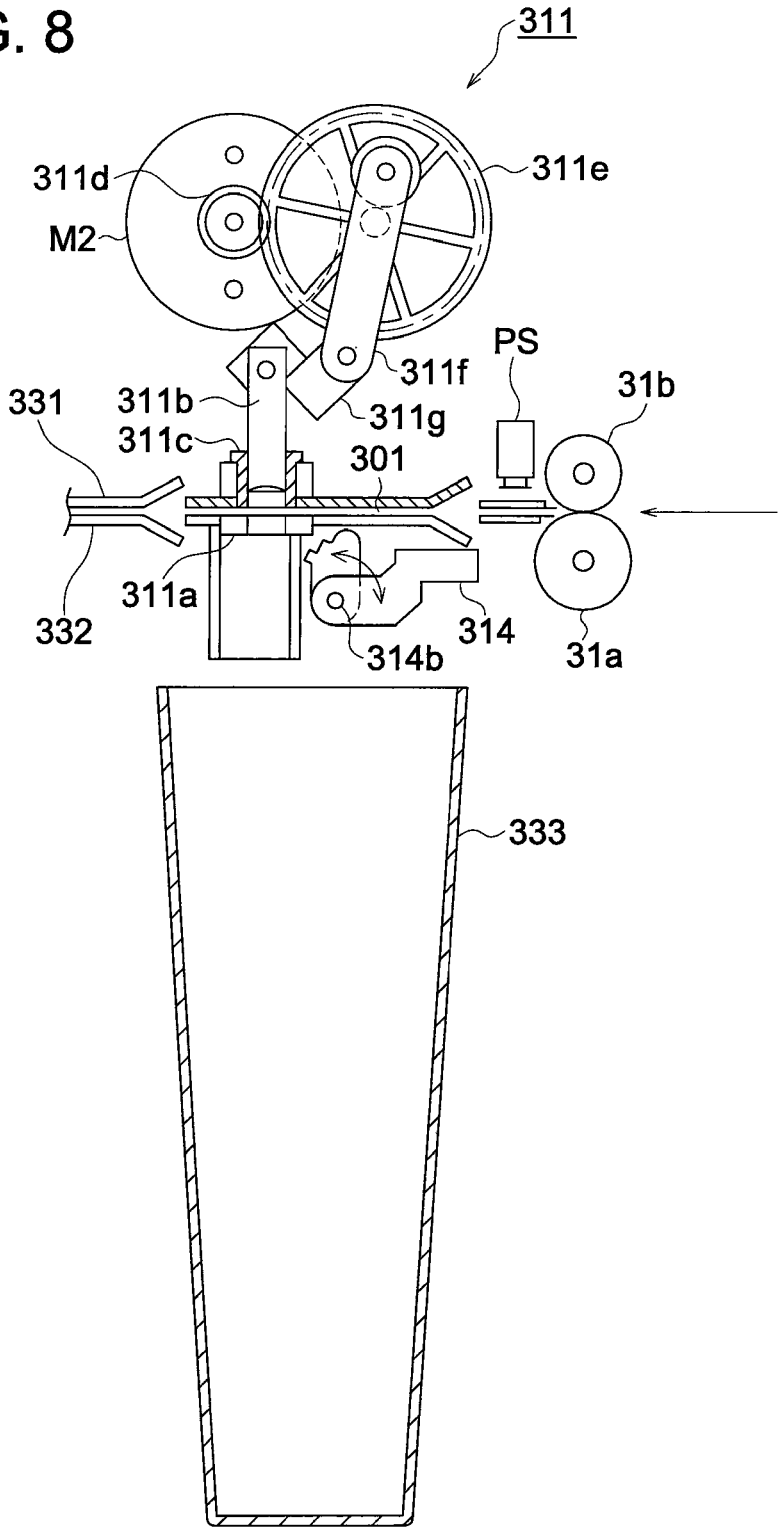
FIG. 8 is a cross-sectional view showing an exemplary perforation mechanism.
Figure 9:
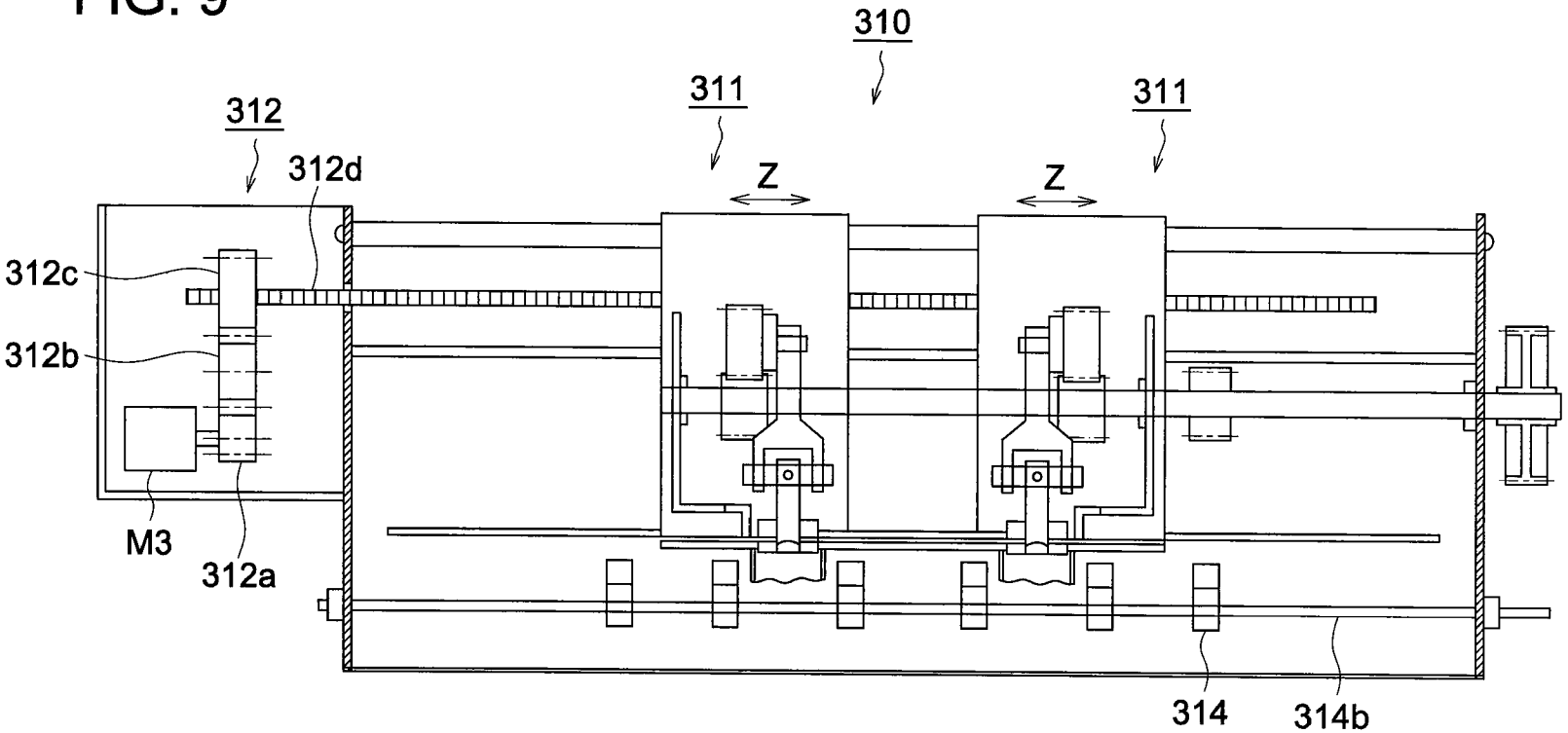
FIG. 9 is a front view showing an exemplary moving mechanism.

FIG. 8 is a cross-sectional view showing an example of the peroration mechanism 311, and FIG. 9 is a front view showing an example of the moving mechanism 312.

The perforation mechanism 311 is provided with a die 311*a* disposed at a sheet conveyance path, a punch 311*b* to hoist and fit with the die 311*a* and a drive section to hoist the punch 311*b*.

A circumferential surface of the punch 311*b* facing the die 311*a* fits with an inner surface of the guide member 311*c* in a hoisting manner. The drive section to hoist the punch 311*b* is provided with drive transmission members such as a motor M2, a small gear 311*d* connected with the motor M2, a large gear 311*e* meshing with the small gear 311*d*, a rotatable crank 311*f* engaged at an end of the large gear 311*e* and a connection member 311*g* to connect the crank 311*f* and the punch 311*b*.

By driving the M2, the punch 311*b* is driven to hoist via the small gear 311*b*, the large gear 311*e*, the crank 311*f* and the connection member 311*g*.

By descent drive of the punch 311*b* and subsequent fitting with the die 311*a*, the notch in the shape of the half circle is formed. Incidentally, the drive mechanism to hoist the punch 302 is not limited to the above mechanism and a publicly know reciprocation mechanism can be utilized.

The moving mechanism 312 moves the relative position of the sheet S and the notch by moving the perforation mechanism 311 from a back side of the bookbinding apparatus B to a front side and vice versa.

When the motor M3 of the moving mechanism 312 is driven, a feeding screw 312*d* rotates via a gear train configured with gears 312*a*, 312*b* and 312*c*. An engaging member (unillustrated) disposed at the perforation mechanism 311 is engaged with the feeding screw 312*d*, and by rotation of the feeding screw 312*d* the perforation mechanism 311 moves in an arrow direction Z. As the feeding screw and the engaging member, a publicly know linier moving mechanism such as a ball screw can be used. Also, a publicly know linier moving mechanism such as a rack and pinion and a wire can be used.

FIG. 9 is an example having two sets of perforation mechanism 311 each having a punch 311*b* and a die 311*a* respectively. Incidentally, number of the sets of the perforation mechanism 311 is not limited to the number thereof. Also, the example shown in FIG. 9 is configured to form one notch by one set of the punch 311*b* and the die 311*a*, however there can be a configuration that one set of the punch 311*b* and the die 311*a* forms a plurality of the notches.

A plurality of contact members 314 are disposed at an upstream side of the punch 311*b* in the sheet conveyance direction. The contact member 314 can rotate centering around the support shaft 314 by an unillustrated stepping motor. Also, the contact member 314 is supported in a sliding manner on the support shaft 314*b* in an axis direction of the supporting shaft, and moves in conjunction with movement of the perforation mechanism 311 in the arrow direction Z through a connection member (unillustrated).

Incidentally, by integrating the perforation mechanism 311, the contact member 314 and the supporting member 314*b* as a unit, the moving mechanism can be simplified, which is preferable.

As described later, the contact member 314 is retracted from the conveyance path 301 of the sheet S until the sheet S is conveyed to a predetermined stop position by the conveyance rollers 31 and 321. Also, when the sheet S is positioned at a peroration position, the contact member 314 is inserted into to the conveyance path 301 of the sheet S so as to contact with the trailing edge of the sheet S and push to convey the sheet S up to the predetermined perforation position. FIG. 9 shows a state where the contact member 314 is retracted form the conveyance path 301.

Incidentally, drive of the contact member 314 is not limited to the stepping motor but the contact member 314 can be inserted and retracted from the conveyance path 301 by a drive source such as a solenoid.

Also, a sensor PS to detect the sheet S is disposed at an upstream side of the perforation device 300 in the sheet conveyance direction.

Next, control of the perforation to form a notch related to the present embodiment will be described.

FIG. 10 is a top view schematically showing positional relations of the sheet S, the width aligning plates 351 and 352 and the contact member 314. In the FIG. 10, for visibility, two contact members 314 are disposed and shown so as to be seen from an upper surface of the conveyance path 301 even while the contact members 314 are being retracted from the conveyance path 301. FIGS. 10*a*, 10*b* and 10*c*, show a state where the contact member 314 is retracted from the conveyance path 301, and FIG. 10*d* shows a state where the contact member 314 is inserted into the conveyance path 301. A symbol L in FIG. 10*d* is a conveyance distance of sheet S conveyed by the contact member 314.

In FIG. 1 and FIG. 2, the sheet S ejected form the sheet ejection rollers 7C of the image forming apparatus A is branched to the conveyance path c when the bookbinding process is selected on the operation section 9 of the image forming apparatus A and conveyed to the perforation device 300 by the conveyance roller 31.

When this occurs, the contact member 314 is retracted from the conveyance path 301 of the sheet S of the perforation section 310 to position of the contact member 314 shown by a solid line in FIG. 4 and FIG. 8) and the sheet S passes through the conveyance path 301 as it is.

A leading edge of the sheet S is conveyed between the upper guide plate 331 and the lower guide plate 332 by the conveyance rollers 321 and 322, and when the sensor PS detects the trailing edge of the sheet S, a timer of an unillustrated device operates and stops rotation of the conveyance rollers 321 and 322 after predetermined time is elapsed. Whereby, the sheet S stops a predetermined position.

The stop position is determined so that the trailing edge of the sheet S is at an upstream side of the predetermined peroration position in the sheet conveyance direction, within the range where the trailing edge of the sheet S can contact with the contact member 314 when the contact member 314 is inserted into the conveyance path 3010 of the sheet S.

However, in case positioning of the sheet stop position is carried out using the conveyance drive system of the sheet S namely the conveyance roller 321 as above, for example in case of the sheet conveyance speed is 100 mm/sec, an control error of 1 m sec creates a displacement of the stop position of the sheet S of 1 mm. As the control error, for example, a detection error of the trailing edge of the sheet S by the sensor PS, and a control error of a motor to drive the drive roller 321*a* are cited. The displacement due to such control error becomes noticeable particularly in a high speed apparatus. Thus, the stop position is set considering such errors.

Figure 10A:
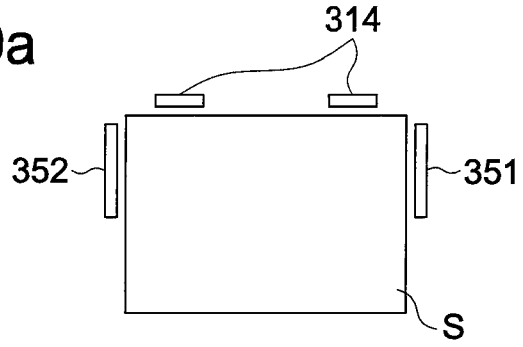
FIGS. 10*a*, 10*b*, 10*c* and 10*d* are schematic diagrams of an upper surface showing positional relations between a sheet, a width aligning plate and a contact member in a perforation process.

When the sheet S stops as above, the sheet S are grasped by the conveyance rollers 321 and 322, and the width aligning plates 351 and 352 are located at a position where the plates are rather outside of the both edges of the sheet S and do not contact with the both edges of the sheet S. FIG. 4 shows a state where the sheet S stops at the stop position. Also, FIG. 10*a* shows positional relations between the sheet S, the width aligning palates and the contact member 314.

Figure 6:
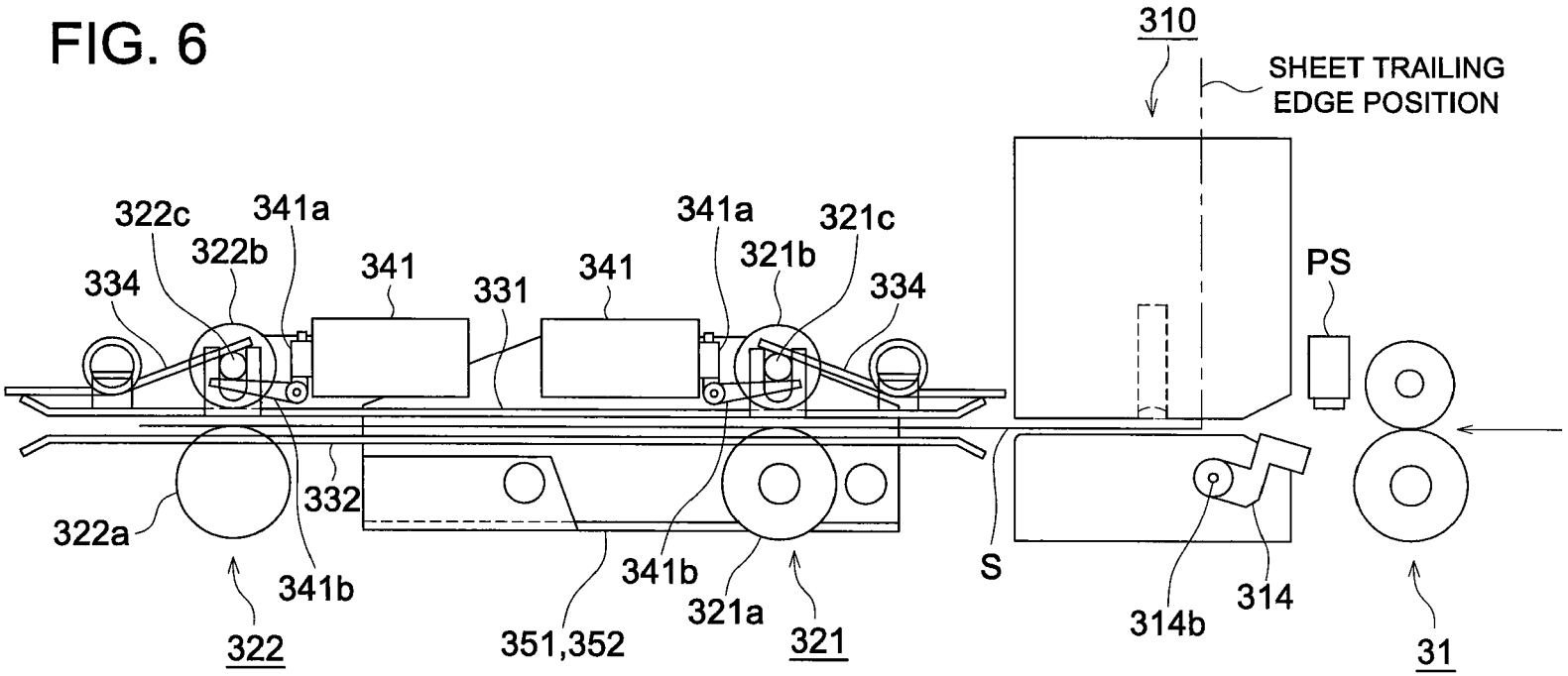
FIG. 6 is a view showing a status where conveyance rollers are released from pressing.

Next, when rotation of the conveyance rollers 321 and 322 stop, in a state shown in FIG. 4, power is supplied to the two solenoids 341 and each plunger 341*a* is retracted into the solenoid 341. Then the both crank levers 341*b* rotate and ends of the drank levers 341*b* push lower parts of the support shafts 321*c* and 322*c* of the driven rollers 321*b* and 322*b* against bias force of the torsional coil springs 334 upward so as to release pressure contact of the driven rollers 321*b* and 322*b* with the drive rollers 321*a* and 322*a*. FIG. 6 is a state where the pressure contact of the conveyance rollers 321 and 322 is released.

Figure 10B:
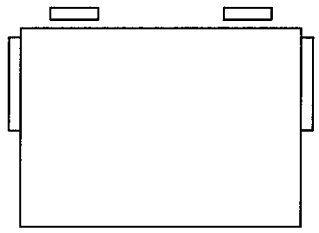

When the pressure contact of the driven rollers 321*b* and 322*b* with the drive rollers 321*a* and 322*a* is released, since the grasping of the sheet S by each roller is released, a stepping motor (unillustrated) is driven to rotate a belt 355 so that the width aligning plates 351 and 352 are moved toward a center. Whereby, the both sides of the sheet S are pressed and the sheet S is aligned in the width direction. FIG. 10*b* shows positional relations of the sheet S, the width aligning plates 351 ad 352 and the contact member 314, when this occurs.

Figure 10C:
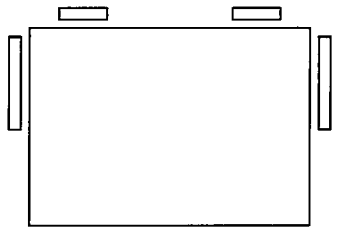

When width aligning of the sheet S is completed, the width aligning plates 351 and 352 are moved away from both sides of the sheets S by driving the stepping motor (unillustrated) in an opposite direction to that of width aligning so as to rotate the belt 335 in a reverse direction and to move the width aligning plates 351 and 352 outward. FIG. 10*c* shows positional relations of the sheets, the width aligning plates 351 and 352 and the contact member 314, when this occurs.

Next, by driving a stepping motor (unillustrated) for rotate the contact member 314, the contact member 314 having been retracted form the conveyance path 301 of the sheet S is inserted into the conveyance path 301 to the sheet S so as to contact with the trailing edge of the sheet S. Further, by rotating the contact member 314, the sheet S is pushed and conveyed to the predetermined perforation position.

As described in the forgoing, at aligning in the with direction of the sheet S, the distance between the aligning plates 351 and 352 is usually about 0.5 mm wider than a regular width of the sheet S, however since the tolerance of cutting width of the sheet is ±2 mm, the aligning plates 351 and 352 may grasp the sheet or may not grasp the sheet. Thus during the width aligning by the width aligning plates 351 and 352, in case of the sheet cutting width is more than 5 mm, if positioning in the sheet conveyance direction is carried out by the contact member 314, the positioning in the sheet conveyance direction is carried out in a state where the aligning plates are grasping the sheet. Whereby, there occur differences of slippage and a degree of deformation of the sheet when the contact member 314 pushes the sheet and a positional accuracy of notch forming (or punching hole) is deteriorated.

Contrarily, in the present embodiment, when the width aligning of the sheet S is completed as above, the width aligning plates 351 and 352 are moved away form the both side edges of the sheet S, then the contact member 314 contacts with the sheet S so as to push and convey the sheet S to the predetermined perforation position. Thus, the sheet S is not restricted by the width aligning plates 351 and 352 when the contact member 314 conducts conveyance direction positioning of the sheet S without the differences of slippage and a degree of deformation of the sheet when the contact member 314 pushes the sheet to occur. Therefore, positioning of the sheet S at perforation can be carried out accurately.

Next, the width aligning plates 351 and 352 are moved away form the both side edges of the sheet S and energizing of the two solenoids 341 is ceased in a state where the contact member 314 have pushed and conveyed the sheet S to the predetermined perforation position. Then each plunger 341*a* protrudes and an end of the crank lever 341*b* is retracted from a lower part of the support shafts 321*c* and 322*c* of the driven roller 321*b* and 322*b* downward. Whereby, the drive rollers 321*a* and 322 contact with the drive rollers 321*a* and 322*a* with pressure by a bias force of the torsional coil spring 334 again. Namely, the sheet S is grasped by each roller again.

Figure 7:
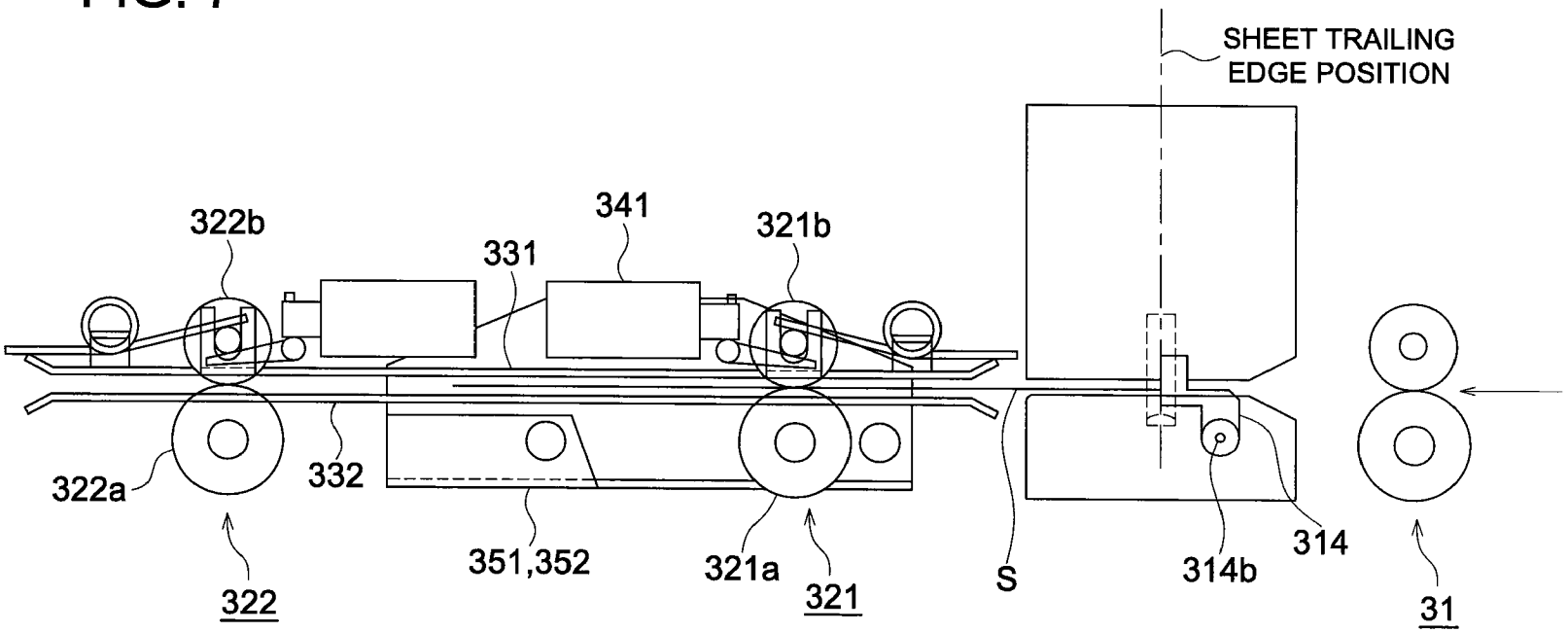
FIG. 7 is a view showing a status where a sheet having been conveyed to a perforation position is grasped by conveyance rollers.
Figure 10D:
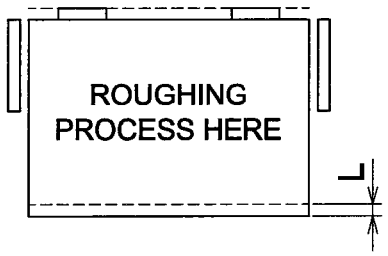

FIG. 7 shows a state where the sheet S is conveyed to the perforation position of the notch and grasped by the conveyance rollers 321 and 322. FIG. 10*d* shows positional relations of the sheet S, the width aligning plates 351 and 352 and the contact member 314, when this occurs.

Next, by driving the perforation mechanism the notch is formed on the trailing edge of the sheet S.

Further, in forming the notch, in case the number of the notches formed on the sheet S is greater than that the perforation mechanism 311 can form in one time, and the notches are formed on each sheets with displacing the notch position, the peroration device 311 is shifted by the shifting mechanism 312 to conduct perforation.

As above, when forming the notch, by grasping the sheet S by pressing the conveyance rollers 321 and 322, displacing of the sheet S at perforation can be suppressed. In particular, compared to forming a round hole, in case of forming notches of the half circle, V shape and U shape, a displacing force in conveyance direction acts on the sheet S at perforation. Thus, by grasping the sheet S, the displacing force can be suppressed and accuracy of notch position can be enhanced.

In the above embodiment (Referred as an embodiment 1), each operation of the width aligning by width plates 351 and 352, and the positioning of perforation position by the contact member 314 is carried out with time series consecutively. However, as another embodiment (embodiment 2), width aligning and positioning of the perforation position can be carried out substantially simultaneously.

EMBODIMENT 2

FIG. 11 is a schematic diagram of an upper surface showing positional relations of the sheets, the aligning plates 351 and 352, the contact member 314 in a perforation process of the embodiment 2. The descriptions other than the following conform to that of the embodiment 1. FIGS. 11*a* and 11*b* conform to FIGS. 10*a* and 10*b*.

Figure 11A:
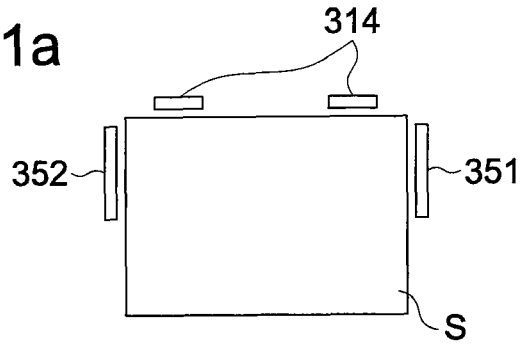
FIGS. 11*a*, 11*b*, 11*c* and 11*d* are schematic diagrams of an upper surface showing positional relations between a sheet, a width aligning plate and a contact member in a perforation process in another embodiment.
Figure 11B:
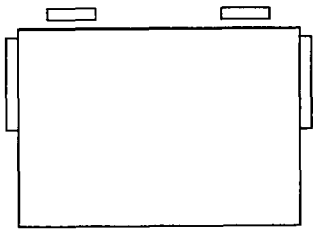
Figure 11C:
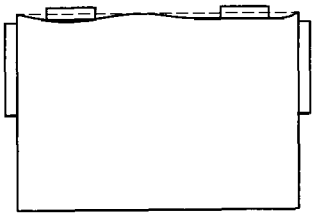

First, operation of the width aligning of width aligning plates 351 and 352 and operation of the contact member 314 starts substantially simultaneously. Namely, during operation of the width aligning by the width aligning plates 351 and 352, operation of positioning of the peroration position by the contact member 314 is carried out. FIG. 11*c* shows positional relations of the sheet S, width aligning plates 351 and 352 and the contact plate 314, when this occurs. In case the sheet s is grasped by the aligning plates 351 and 352, as FIG. 11*c* shows, a deformation or distortion occurs at a vicinity of the trailing edge of the sheet S by the contact member 314 to press the trailing edge of the sheet S.

Figure 11D:
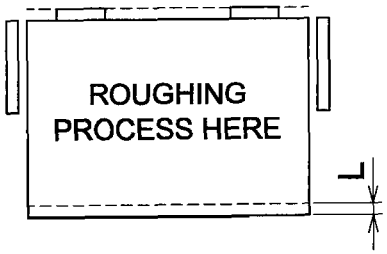

Next, after the width aligning plates 351 and 352 are retracted from the sheet aligning position and grasping of the sheet S is released, the operation of the contact member is terminated. Whereby, the sheet S is released from restriction by the width aligning plates 351 and 352, thus distortion of sheet S at the vicinity of the trailing edge shown in FIG. 11*c* is resolved. FIG. 11*d* shows the above state.

After that, the sheet s is grasped by the conveyance rollers 321 and 322 being pressed, and a preliminary operation of notch forming based on the embodiment 1 is performed.

In embodiment 2, an operation time which is sum of an operation time of width aligning operation of the width aligning plates 351 and 352, and an operation time of the contact member 314 can be shorten and a processing efficiency of the apparatus can be enhanced with respect to the embodiment 1.

Figure 12A:
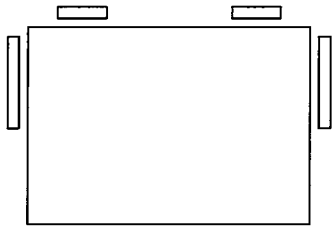
FIGS. 12*a*, 12*b*, and 12*c* are schematic diagrams of an upper surface showing positional relation between a sheet, a width aligning plate and a contact member in a conventional perforation process.
Figure 12B:
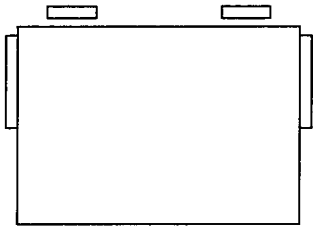
Figure 12C:
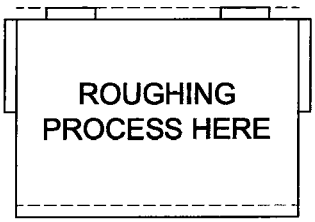

FIG. 12 shows an example of prior art. FIGS. 12*a* and 12*b* conform to FIGS. 10*a* and 10*b*.

Conventionally, after a state shown by FIG. 12*b*, the conveyance rollers 321 and 322 come to the pressure contact in a state where the sheet S is grasped by the width aligning plates 351 and 352 to be restricted, thereafter the contact member 314 pushes the trailing edge of the sheet S to perform positioning. Thus the perforation is carried out in a state where distortion and deformation occur at the vicinity of the trailing edge (FIG. 12*c*) and maintaining of positional accuracy of the notch was difficult.

Figure 13:
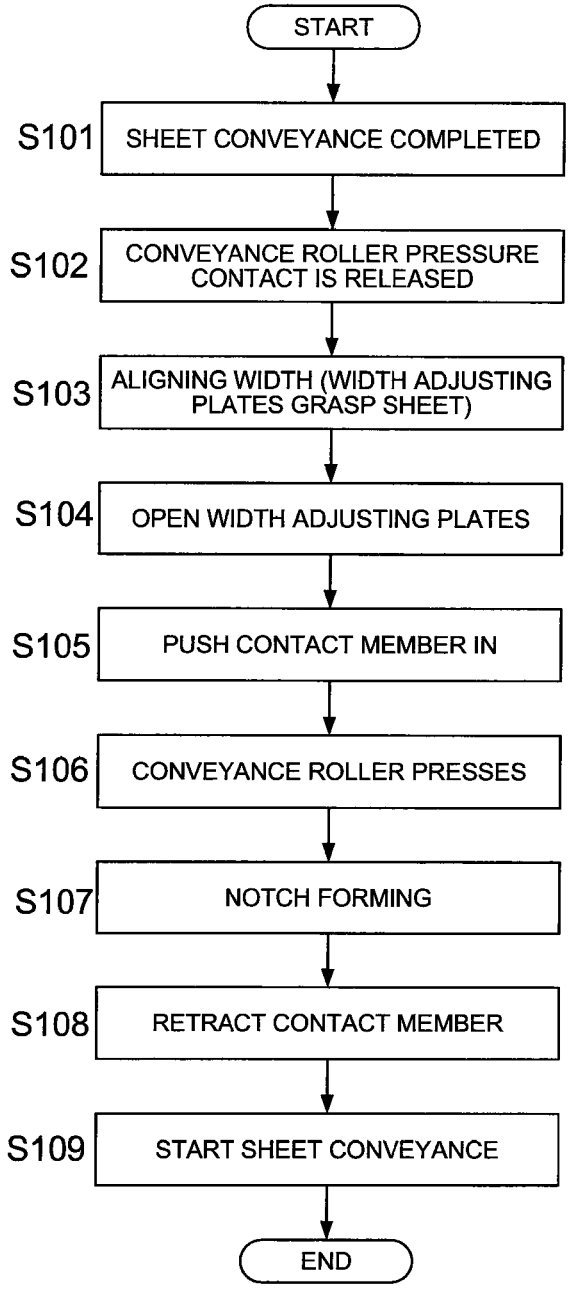
FIG. 13 is a flow chart of operation control related to the present embodiment.
Figure 14:
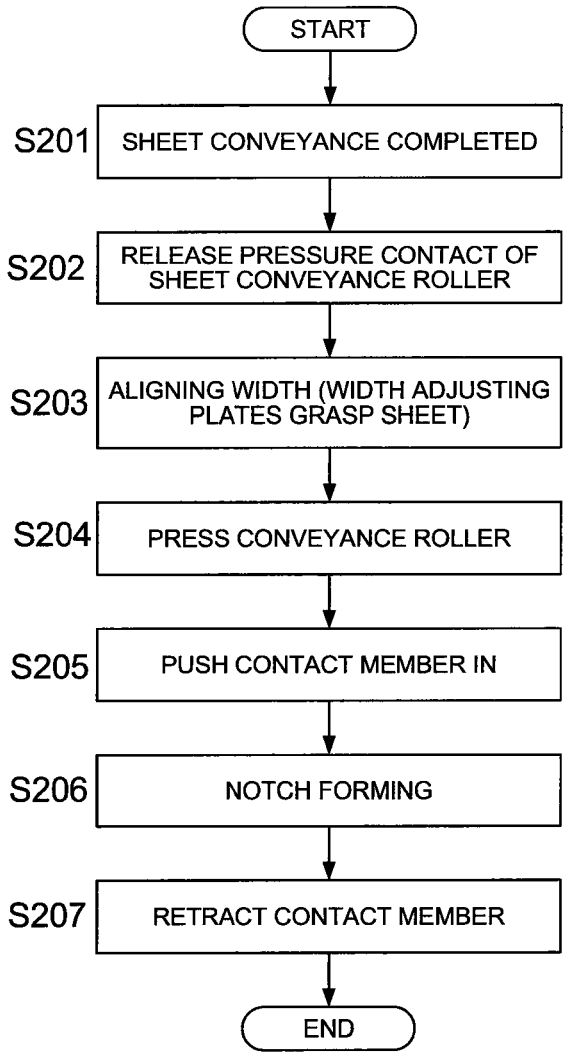
FIG. 14 is a flow chart of operation control of conventional example.

FIG. 13 is a flow chart of operation control having been described in the above embodiment 1. FIG. 14 is a flow chart of the operation control having been described in the above conventional example.

As above, in the present embodiments, when width aligning of the sheet S is completed, the width aligning plates 351 and 352 move away form both side edges of the sheet S, then the contact member 314 comes to contact with the sheet S so as to press and convey the sheet S to the predetermined peroration position. Whereby, the sheet S is not restricted by the width aligning plates 351 and 352 when positioning of the sheet S in the conveyance direction by the contact member 314 is carried out and irregularity of slippage and distortion when the contact member 314 pushes the sheet S can be eliminated. Thereby the sheet S can be accurately positioned when perforating.

Also, by grasping the sheet S while pressing the conveyance rollers 321 and 322, displacing of the sheet S at perforation can be suppressed. In particular, in case of the notches in the shape of a half circle, V-shape and U-shape, since a displacing force in the conveyance direction acts compared to the circle hole, the displacing force can be suppressed and the positional accuracy of the notch can be enhanced by grasping the sheet S.

Figure 15:
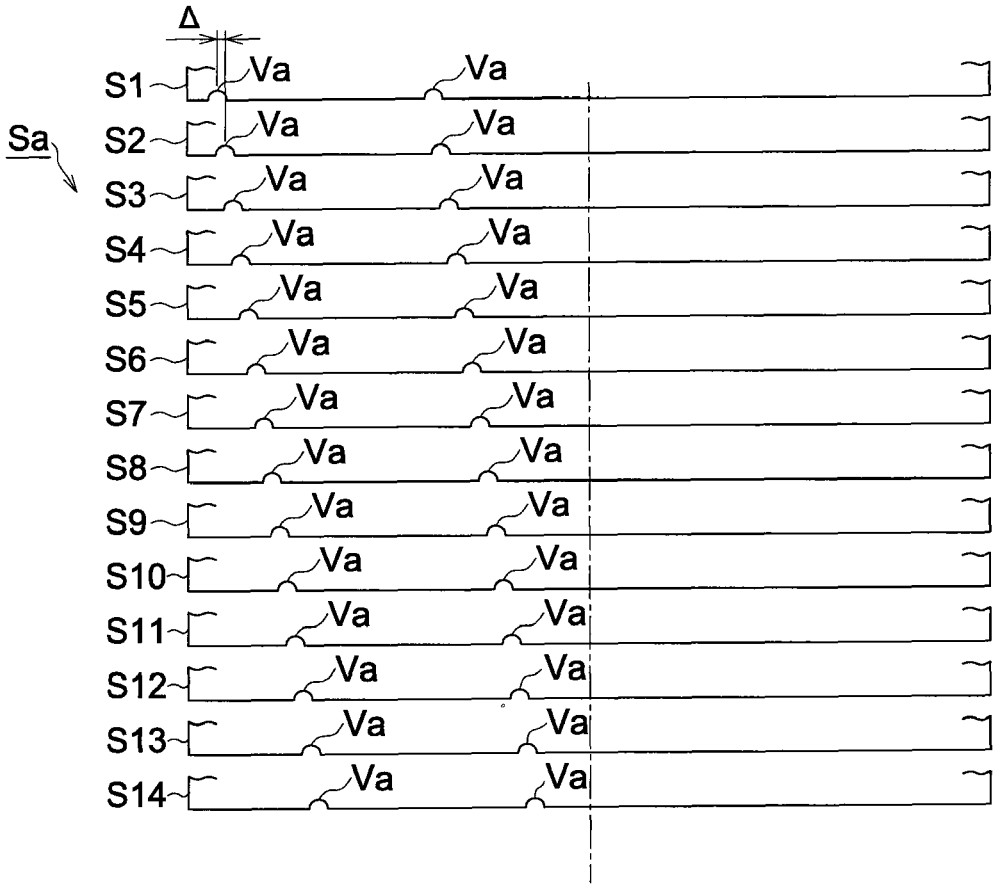
FIG. 15 is a plane view of a sheet bundle accumulating a plurality of sheets on which notches are formed.

FIG. 15 is a plane view of a sheet bundle Sa accumulating a plurality of sheets (S1 to S14) on which two notches Va are formed on each sheet S which is displaced each other.

The perforation mechanism 311 moves to a predetermined position at a left side in the figure by the moving mechanism 312 then two notches Va in the shape of a half circle are perforated on the first sheet S1 by two sets of perforation mechanisms 311 having punches 311*b* and dies 311*a*.

Next, the perforation mechanism 311 moves by a predetermined distance Δ to the left in the figure by the moving mechanism 312, and two notches Va in the shape of a half circle are perforated on the second sheet S2 by two sets of perforation mechanisms 311.

In the same manner, the notches Va having the perforation positions displaced by the predetermined distance Δ are perforated subsequently.

Here, four notches Va can be perforated in a way that two notches Va are perforated on the left of the sheet S in the figure as above, then the perforation mechanism 311 is moved to a right side in the figure by the moving mechanism 312 to perforate two notches Va at a predetermined position on the right in the figure.

Figure 16A:
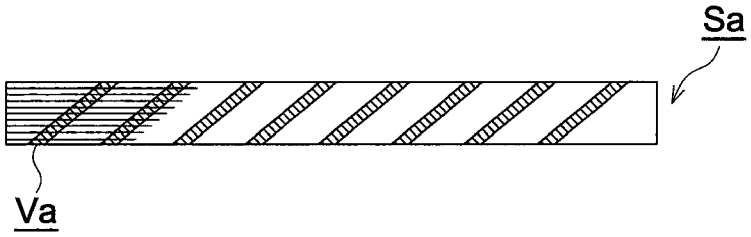
FIGS. 16*a* and 16*b* are views showing a notched surface of a sheet bundle accumulating sheets on which notches are formed.
Figure 16B:
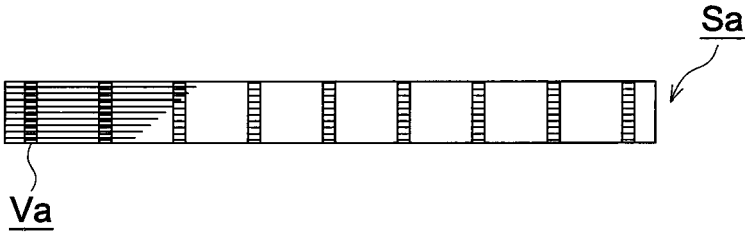

FIG. 16 shows a notched surface of the sheet bundle which is formed by accumulating the sheets S on which the notches Va are formed as above. FIG. 16*a* is a view where the notches Va are formed on the sheets S which is displaced each other, and FIG. 16*b* is a view where the notches Va are formed at the same position for all sheets S.

<Reversal Section 30>

The sheet S on which the notches are formed by the perforation mechanism 311 is grasped by the conveyance rollers 32, 33 and 34, and stored in a predetermined position of a reversal section 30. The reversal section 30 is provided with a sheet placing table 35 obliquely disposed, a sheet trailing edge positioning member 36 capable of swinging, a aligning member 37 to align the sheet S in the sheet width direction and a conveyance roller 38.

<Sheet Bundle Storing Section 40>

Figure 17:
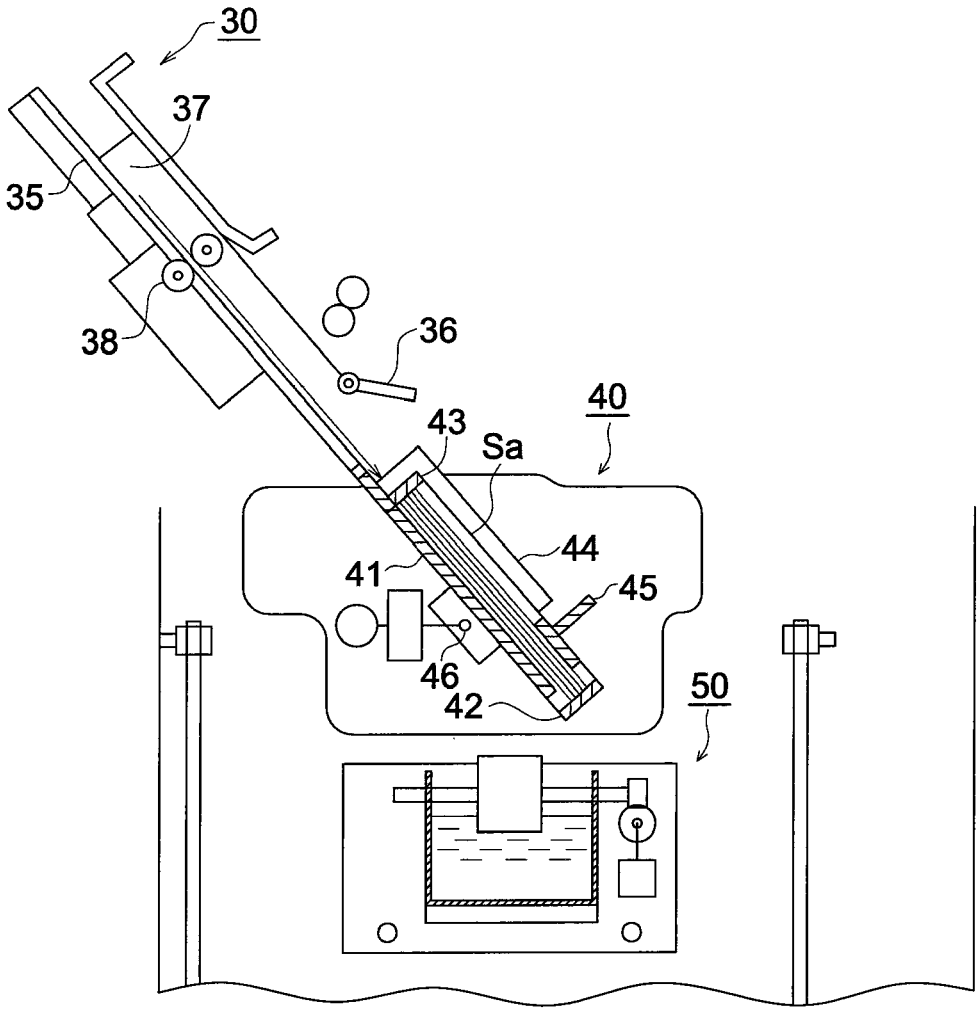
FIG. 17 is a cross-sectional view of a sheet accumulation section of a sheet bundle storing section disposed in an oblique state.

FIG. 17 is a cross sectional view showing a state where the sheet accumulation section of the sheet bundle storing section 40 is disposed obliquely.

The sheet bundle storing section 40 is provided with a support member 41, a receiving plate 42, a lateral aligning member 44 and a pressure contact member 45.

The sheet S placed on the sheet placing table 35 of the reversal section 30 is grasped and conveyed by the conveyance rollers 38 and ejected through an opening which has been opened by swing motion of the positioning member 36 to position the sheet trailing edge, and then conveyed downward obliquely. The sheet S is accumulated subsequently in the sheet bundle storing section 40.

The sheet bundle storing section 40 is provided with a support member 41 having an oblique accumulation surface and a receiving plate 42 to be able to swing. The sheet S descending from the reversal section 30, slides on the accumulation surface of the oblique support member 41, and stops when the leading edge of the sheet S comes to contact with the receiving plate 42 and the sheet S is supported in an oblique state.

A longitudinal aligning member 43 performs longitudinal aligning in order to justify the leading edge of the sheet S by pressing the trailing edge of the sheet S so as to contact the leading edge of the sheet S with the receiving plate 42.

The sheets S subsequently ejected from the image forming apparatus A, are subject to switch-back conveyance in the reversal section 30, and accumulated in the sheet bundle accumulating section 40 so as to be subject to longitudinal and lateral aligning to be described, thus a sheet bundle Sa configured with a plurality of the sheet S is formed.

A size of the sheet S and number of the sheets S in the sheet bundle Sa representing setting conditions of a booklet are set in an operation section 9 of the image forming apparatus A shown in FIG. 1 or set by an external devices such as a personal computer connected with the image forming apparatus A.

The lateral aligning member 44 performs lateral aligning in the sheet width direction by pressing side edges of the sheet S conveyed form the reversal section 30 then stored in the sheet bundle storing section 40.

When an offline system is operated to perform a bookbinding process on its own, energizing to the lateral aligning member is ceased, and a sheet bundle brought from an outside to the sheet bundle storing section 40 is aligned in the width direction by operating the lateral aligning member 44 manually.

The pressing member 45 presses and grasps the sheet bundle Sa accumulated in the sheet bundle storing section 40 in a thickness direction. When a predetermined number of the sheets S are stored in the sheet bundle storing section 40, the pressing member 45 is driven by an unillustrated drive section so that a grasping section configured with the supporting member 41 and the pressing member 45 grasp and holds the sheet bundle Sa.

Figure 18:
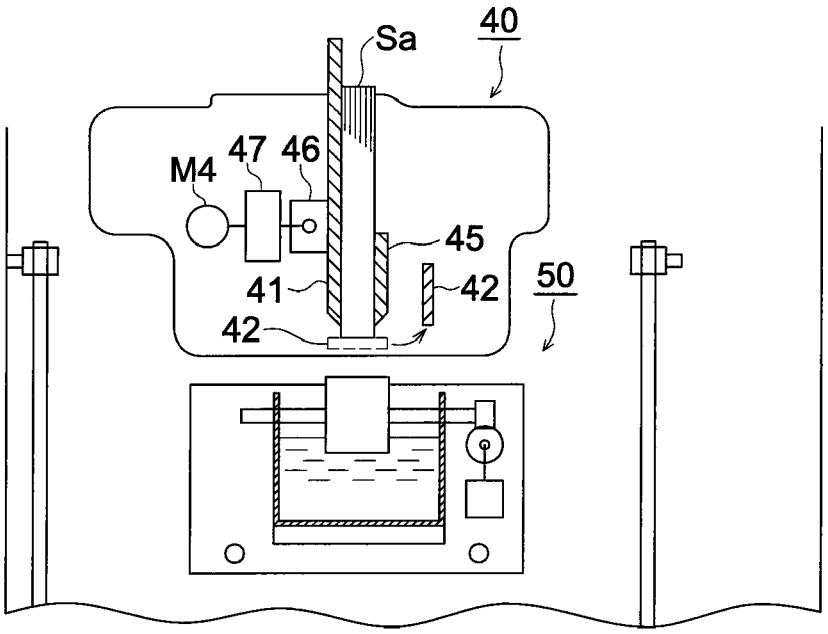
FIG. 18 is a cross-sectional view of a sheet accumulation section of a sheet bundle storing section disposed in a vertical state.

FIG. 18 shows is a cross sectional view showing the sheet accumulation section of the sheet bundle storing section 40 in the vertical state.

The supporting member 41 and the pressing member 45 holding the sheet bundle Sa rotates centering around an axis 46 of the sheet bundle storing section 40 by a motor M4 and a drive section 47 so that the sheet bundle Sa becomes in a vertical state from an oblique state. In the above state, an application section 50 is retracted in a downward and the lower surface of the sheet bundle Sa is separated from an application roller 51 of the application section 50.

Also, in the state where the supporting member 41 and the pressing member 45 are holding the sheet bundle Sa, the receiving plate 42 is driven by an unillustrated section and rotated to be retracted from a broken lines position to a solid line position.

<Application Section>

Figure 19:
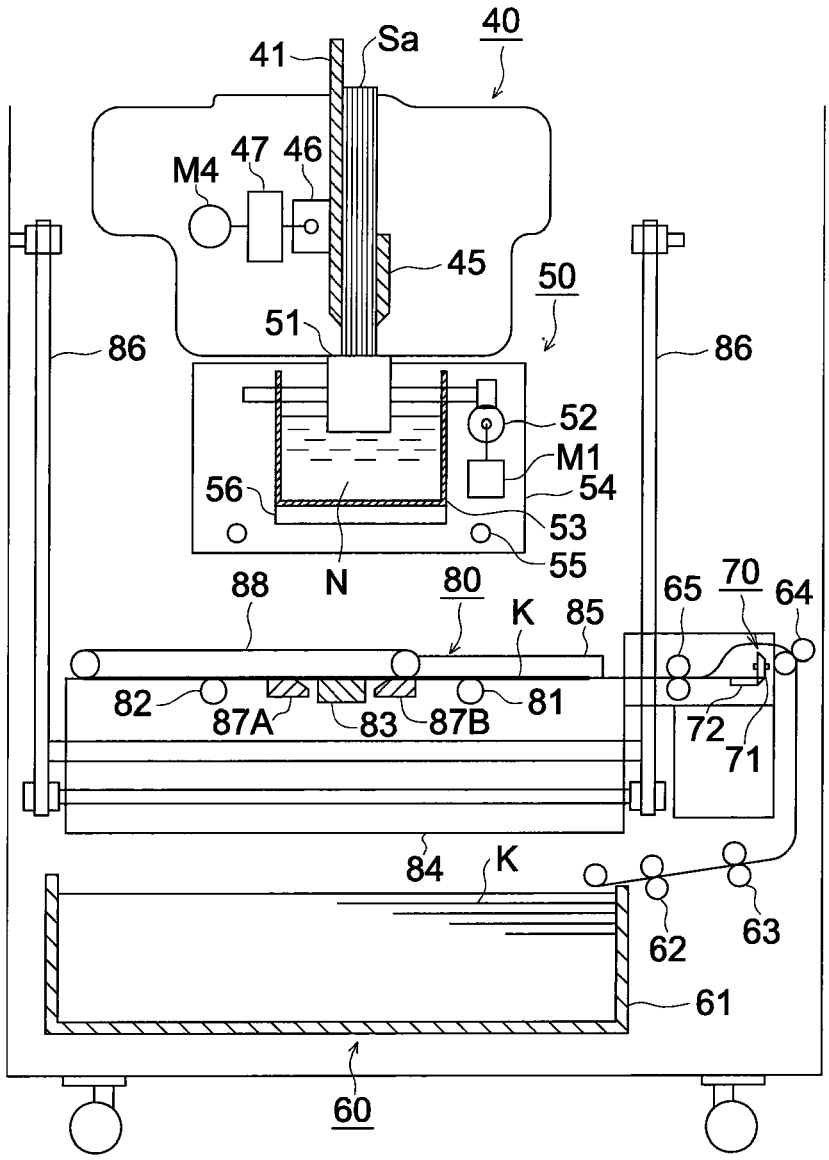
FIG. 19 is a cross-sectional view of a sheet bundle storing section, an application section, coversheet supply section, cutting section and booklet forming section.

FIG. 19 is an across-sectional view of the sheet storing section 40, the application section 50, a coversheet supply section 60, a cutting section 70 and a booklet forming section 80.

The application section is configured with an application roller 51, a drive section 52 to drive and rotate the application roller 51, a container 53 to contain an adhesive N such as glue, a moving body 54 capable of moving the container 53 from an initial position at an rear side of the bookbinding apparatus B to an application position of the adhesive at a front side while holding the container 53, a moving section 55 to reciprocate the moving body 54 and a heating section 56 to heat the adhesive N contained in the container 53.

<Application of the Adhesive to the Sheet Bundle>

The moving body 54 of the application section 50 is moved by the drive section 47 in a direction parallel to a longitudinal direction of the lower surface of the sheet bundle Sa held in the vertical state by the grasping section configured with the supporting member 41 and pressing member 45.

The moving body 54 starts to move from the initial position at the rear side of the bookbinding apparatus B and moves along the moving section 55 then stops at a predetermined position at front side of the bookbinding apparatus B, thereafter the moving body 54 is driven in a reverse manner to return to the initials position.

Figure 20:
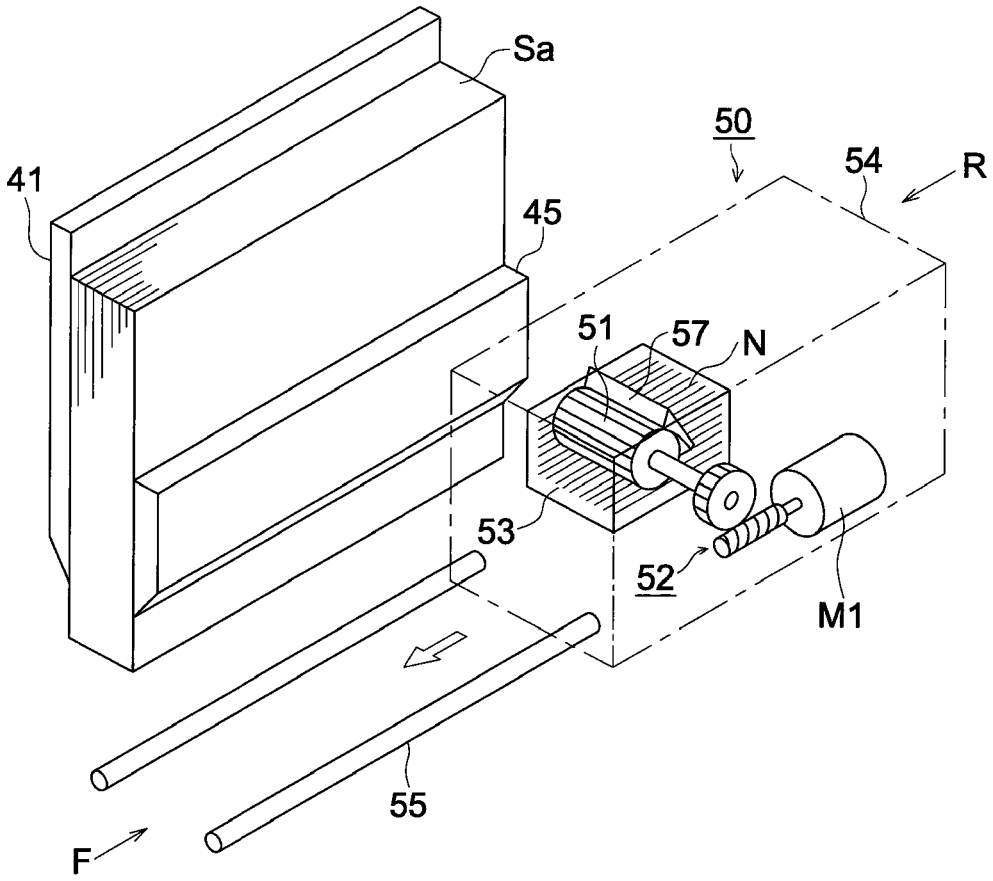
FIG. 20 is a perspective view of an application section and a grasping section.

The FIG. 20 is a perspective view of the application section 50 and the grasping section.

The motor M1 and the drive section 52 rotate the application roller 51 immersed in the adhesive container 53 containing the adhesive N. By a forward movement or reciprocation movement, the adhesive application roller 51 applies the adhesive N from a back surface side R to a front surface side F in the longitudinal direction of the lower surface of the sheet bundle Sa held in the vertical state.

<Coversheet Supply Section 60>

As FIG. 19 shows, a coversheet K stored in the coversheet stacking section 61 of the coversheet supply section 60 is separated and fed by the sheet feeding section 62, then grasped by the conveyance rollers 63, 64 and 65 to be conveyed to the booklet forming section 80.

<Cutting Section 70>

The cutting section 70 integrally configured above the coversheet supply section 60 at a right side of the booklet forming section 80 to be described in the figure, cuts the coversheet K in the conveyance direction in a predetermined length with a rotary cutter configured with a rotation blade 71 and a fixed blade 72.

The predetermined length means a length of sum of a length of two pieces of the sheets S in a traveling direction and a length of a spine of the sheet bundle Sa. For example, in case the coversheet K is bonded on the spine of the sheet bundle Sa configured with sheets S of A4 size to perform case binging, provided that the maximum number of the sheet S in the sheet bundle Sa is 300 and a thickness of the sheet bundle Sa is 30 mm, the predetermined length is set at 450 mm which is two times of the length of the short side of A4 sheet 210 mm plus the thickness of 30 mm, and an edge section the coversheet K is cut. A wide size whose total length before cutting the coversheet K is not less than 450 mm is used as coversheet K.

In case of case binding using the sheets of A5 size, B5 size, and 8.5×11 inch size (1 inch is 25.4 mm) to form each booklet Sb, the predetermined length is set in accordance with the short side of the sheet and the thickness of the sheet bundle.

When the sheet size, the number of the sheets, and thickness of the sheet is selected and set or detected on the operation section 9 of the image forming apparatus A or an external device, the control section sets a predetermined setting length of the coversheet K. The length of the coversheet K before cutting is determined in accordance with a maximum number of the sheet and the coversheet K is stored in the coversheet stacking section 61 of the coversheet supply section 60.

<Booklet Forming Section 80>

The booklet forming section 80 is provided with conveyance rollers 81 and 82 to receive, convey and stop the coversheet K supplied form a coversheet supply section 60 at a predetermined position, a pressure member 83 to press the coversheet K onto an adhesive application surface of the sheet bundle Sa, a moving housing 84 to support the conveyance rollers 81 and 82 and the pressure member 83, and a hoisting member 86 to hoist the aligning section 85 and moving housing 84 in a vertical direction up and down.

The booklet forming section 80 and the booklet ejection belt 88 hoist integrally by the hoisting section 86.

When the booklet forming section 80 stops at a descent position to enter the coversheet K, the aligning section 85 moves in accordance with the size of the coversheet K from an initial position and performs width aligning by pressing both sides surfaces of the coversheet K before cutting process. The coversheet K whose skew is corrected by the width aligning, is subject to switch-back to be conveyed in an opposite direction to an entering direction to the cutting section to be cut in the predetermined position.

Also, before the booklet forming section 80 affixes the coversheet K after cutting onto the spine of the sheet bundle Sa at the descent position, the aligning section 85 moves from the initial position again to press the both sides surfaces of the coversheet K to perform width aligning and stop the coversheet K at a predetermined position. After that, the aligning section 85 returns to the initial position so as not to interfere bonding of the coversheet K and the sheet bundle Sa and subsequently the booklet forming section 80 ascends. When ascending, the coversheet K is held at a predetermined position.

Therefore, the aligning section 85 disposed in the booklet forming section 80 capable of hoisting performs positioning of the coversheet K having been cut by the cutting section 70 in the coversheet width direction, thus cutting accuracy of the coversheet K is enhanced and a positional accuracy of the sheet bundle Sa and coversheet K is enhanced, whereby the configuration of the apparatus is simplified.

The hoisting section 86 rotates a left and a right belts to moves the moving housing 84 to an upper position. At the upper position thereof, a center section of the coversheet K placed on the pressure member 83 is pressed and bonded with the adhesive N application surface of the sheet bundle Sa. By the above pressure bonding, some of the adhesive N applied goes around at side edges of the front and rear surfaces of the sheet bundle Sa. After completion of the application process of the adhesive onto the sheet bundle Sa, the application section 50 moves backward to be retracted.

<Folding Process>

At an upper part of the booklet forming section 80, a coversheet folding section is disposed. The coversheet folding section is provided with a pair of bilaterally symmetric forming members 87A and 87B. The forming members 87A and 87B is detachable in a thickness direction of the sheet bundle Sa. The forming members 87A and 87B fold the coversheet K along the side edge of the adhesive application surface of the sheet bundle Sa and grasp the sheet bundle Sa and the coversheet K while a reverse and an obverse surfaces of the sheet bundle Sa overlap with a front coversheet and a rear coversheet.

After folding process of the coversheet K, the booklet forming section 80 descends by a predetermined distance to be retraced by descent drive of the hoisting section 86 and stops.

In the above description, the post-processing apparatus was the bookbinding apparatus. However the present embodiment is not limited to the bookbinding apparatus thereof. For example, the present embodiment can be applied to a post-processing apparatus provided with a perforation device to perform punching hole forming for filing. Using the perforation apparatus of the present embodiment, positional accuracy of the punching holes is enhanced and quality of filing is enhanced.

According to the above embodiments, aligning of width direction at perforation for notch forming and positioning of notch position can be carried out accurately with a simple configuration. Also, the displacing force of the sheet at perforation can be suppressed, thus the positional accuracy of the notch can be enhanced. Whereby, irregularity of the sheets having been subject to bookbinding or filing can be obviated, thus quality of bookbinding and filing can be enhanced.

What is claimed is:

1. A perforation apparatus, comprising:

a perforation device which perforates a sheet with a punch to form a notch on an edge of the sheet;

an aligning device comprising a pair of aligning members, wherein the aligning members are movable to align the sheet in a sheet width direction orthogonal to a sheet conveyance direction;

a contact member which contacts with a trailing edge of the sheet, wherein the contact member is capable of being inserted into and retracted from a conveyance path of the sheet, and the contact member is disposed at an upstream side of the punch in the sheet conveyance direction; and a control section configured to control the perforation device, the aligning device, and the contact member, wherein the control section (i) controls the aligning device to perform an aligning operation to align the sheet in the sheet width direction while grasping the sheet with the aligning members, (ii) controls the aligning device to retract the aligning members from the sheet after the aligning operation is completed, (iii) subsequently controls the contact member to push the trailing edge of the sheet and convey the sheet to a predetermined position, and (iv) then controls the perforation device to perforate the sheet with the punch to form the notch on the edge of the sheet.

2. The perforation device of claim 1, wherein the control section controls the aligning device to align the sheet in the sheet width direction while grasping the sheet with the aligning members in a state in which the contact member is retracted, controls the aligning device to retract the aligning members from the sheet after the aligning operation is completed, and subsequently controls the contact member to be inserted into the sheet conveyance path so as to contact with the trailing edge of the sheet and to push and convey the sheet to the predetermined position.

3. The perforation device of claim 1, wherein the control section starts the aligning operation of the aligning members of the aligning device and an operation of the contact member substantially simultaneously, and terminates the operation of the contact member after the aligning members are retracted from the sheet.

4. The perforation apparatus of claim 1, wherein the perforation device perforates the sheet to form the notch as a half circle notch on the edge of the sheet by perforating a hole such that the hole overhangs from the edge of the sheet.

5. A post-processing apparatus, comprising:

the perforation apparatus of claim 1; and a connection device to be connected with an image forming apparatus.

6. The post-processing apparatus of claim 5, further comprising a bookbinding device to receive a sheet on which an image is formed and to perform bookbinding.

7. An image forming system, comprising:

an image forming apparatus to form an image on a sheet; and the post-processing apparatus of claim 5 to carry out post-processing on sheets received from the imaging forming apparatus on which images are formed.

8. The image forming system of claim 7, wherein the perforation device perforates the sheet to form the notch as a half circle notch on the edge of the sheet by perforating a hole such that the hole overhangs from the edge of the sheet.

9. A perforation apparatus, comprising:

a perforation device which perforates a sheet with a punch;

an aligning device comprising a pair of movable aligning members which align the sheet in a sheet width direction orthogonal to a sheet conveyance direction;

a contact member which contacts with a trailing edge of the sheet, wherein the contact member is capable of being inserted into and retracted from a conveyance path of the sheet, and the contact member is disposed at an upstream side of the punch in the sheet conveyance direction;

a pair of conveyance rollers capable of pressing in contact with and releasing from each other, wherein the conveyance rollers are disposed at a downstream side of the perforation device in the sheet conveyance direction, and the conveyance rollers convey the sheet while grasping the sheet therebetween; and a control section configured to control the perforation device, the aligning device, the contact member, and the conveyance rollers, wherein the control section is configured to: (i) control the conveyance rollers to convey the sheet to a predetermined position while grasping the sheet therebetween, (ii) control the conveyance rollers to release the pressure contact thereof, (iii) thereafter, control the aligning device to perform an aligning operation to align the sheet in the sheet width direction by moving the pair of the aligning members toward the sheet, (iv) control the aligning device to retract the pair of aligning members from the sheet after the aligning operation is completed, (v) control the contact member to push the trailing edge of the sheet so as to move the sheet to a perforation position following the retracting of the aligning members from the sheet, (vi) thereafter control the conveyance rollers to contact each other with pressure to grasp the sheet therebetween, and (vii) control the perforation device to perforate the sheet with the punch.

10. The perforation device of claim 9, wherein the control section is configured to control the contact member to be inserted into the sheet conveyance path so as to contact with the trailing edge of the sheet following the retracting of the aligning members, and to push the trailing edge of the sheet to the perforation position.

11. The perforation device of claim 9, wherein the control section is configured to control the contact member to be inserted into the conveyance path of the sheet during the aligning operation of the sheet in the sheet width direction, control the aligning device to retract the aligning members from the sheet following completion of the aligning operation, and control the contact member to push the trailing edge of the sheet to the perforation position.

12. The perforation device of claim 9, wherein the perforation device perforates the sheet to form a half circle notch on an edge of the sheet by perforating a hole such that the hole overhangs from the edge of the sheet.

13. A perforation apparatus, comprising:

a perforation device which perforates a sheet with a punch;

an aligning device comprising a pair of movable aligning members which align the sheet in a sheet width direction orthogonal to a sheet conveyance direction;

a contact member which contacts with a trailing edge of the sheet in a conveyance path of the sheet, and which is disposed at an upstream side of the punch in the sheet conveyance direction; and a control section configured to control the perforation device, the aligning device, and the contact member, wherein the control section is configured to: (i) control the aligning device to perform an aligning operation to align the sheet in the sheet width direction by moving the pair of the aligning members of the aligning device toward the sheet, (ii) control the contact member to contact the sheet following a start of the aligning operation of the sheet by the aligning members of the aligning device, (iii) control the aligning device to retract the aligning members from the sheet and control the contact member to push the trailing edge of the sheet so as to move the sheet to a perforation position following the retracting of the aligning members from the sheet, and (iv) control the perforation device to perforate the sheet with the punch.

14. The perforation device of claim 13, wherein the contact member is retractable from the conveyance path of the sheet, and wherein the control section is configured to control the aligning device to retract the aligning members from the sheet following completion of the aligning operation, control the contact member to be inserted into the conveyance path of the sheet so as to contact with the trailing edge of the sheet following the retracting of the aligning members, and control the contact member to push the trailing edge of the sheet to the perforation position.

15. The perforation device of claim 13, wherein the contact member is retractable from the conveyance path of the sheet, and wherein the control section is configured to control the contact member to be inserted into the conveyance path of the sheet during the aligning operation of the sheet in the sheet width direction, control the aligning device to retract the aligning members from the sheet following the completion of the aligning operation, and control the contact member to push the trailing edge of the sheet to the perforation position.

16. The perforation device of claim 15, wherein the control section is configured to control the contact member to be inserted into the conveyance path of the sheet substantially simultaneously with a start of the aligning operation of the sheet by the aligning members in the sheet width direction, control the aligning device to retract the aligning members from the sheet following the completion of the aligning operation, and control the contact member to push the trailing edge of the sheet to the predetermined perforation position.

17. The perforation device of claim 13, wherein the perforation device perforates the sheet to form a half circle notch on an edge of the sheet by perforating a hole such that the hole overhangs from the edge of the sheet.

18. The perforation apparatus of claim 1, wherein notches formed on each of a plurality of sheets are displaced each other.

* * * * *